US007789503B2

(12) United States Patent
Kusunoki

(10) Patent No.: US 7,789,503 B2
(45) Date of Patent: Sep. 7, 2010

(54) IMAGE FORMING APPARATUS AND IMAGE FORMING METHOD

(75) Inventor: Naoki Kusunoki, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 1057 days.

(21) Appl. No.: 11/504,721

(22) Filed: Aug. 16, 2006

(65) Prior Publication Data

US 2007/0040885 A1 Feb. 22, 2007

(30) Foreign Application Priority Data

Aug. 17, 2005 (JP) ..... 2005-236554
Sep. 20, 2005 (JP) ..... 2005-272391

(51) Int. Cl.
*B41J 2/01* (2006.01)
*B41J 2/015* (2006.01)

(52) U.S. Cl. ..... 347/102; 347/21; 347/101

(58) Field of Classification Search ..... 347/102, 347/101, 21; 101/488; 219/216; 346/25
See application file for complete search history.

(56) References Cited

U.S. PATENT DOCUMENTS 5,732,477 A * 3/1998 Toyama ..... 34/275
6,145,979 A * 11/2000 Caiger et al. ..... 347/102
6,354,700 B1 * 3/2002 Roth ..... 347/103
6,499,893 B2 * 12/2002 Harada et al. ..... 396/575
7,137,696 B2 * 11/2006 Siegel ..... 347/102
7,152,969 B2 * 12/2006 Hintermann ..... 347/102
7,249,836 B2 * 7/2007 Yokoyama ..... 347/102
7,510,277 B2 * 3/2009 Konno et al. ..... 347/102
2003/0011670 A1 * 1/2003 Shirakawa ..... 347/102
2003/0035037 A1 * 2/2003 Mills et al. ..... 347/102
2003/0184631 A1 * 10/2003 Suzuki et al. ..... 347/102
2003/0202082 A1 10/2003 Takabayashi
2005/0104946 A1 * 5/2005 Siegel ..... 347/102
2006/0007290 A1 * 1/2006 Oshima et al. ..... 347/102
2006/0230969 A1 * 10/2006 Vosahlo ..... 101/488

FOREIGN PATENT DOCUMENTS

JP 2001-1512 A 1/2001
JP 2001-129982 A 5/2001
JP 2003-251910 A 9/2003
JP 2004-42548 A 2/2004

* cited by examiner

*Primary Examiner*—Stephen D Meier
*Assistant Examiner*—Leonard S Liang
(74) *Attorney, Agent, or Firm*—Birch, Stewart, Kolasch & Birch, LLP

(57) ABSTRACT

The image forming apparatus, comprises: a plurality of ejection heads which eject liquid containing, a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, an ultraviolet-polymerizable compound, and a coloring material, onto a medium; a semi-curing device which radiates, at least once, ultraviolet light having at least a wavelength which is in the first wavelength range and which is on a longer wavelength side from the second wavelength range, onto dots formed by the liquid ejected from the ejection heads onto the medium; an intermediate processing device which performs intermediate processing of an image formed on the medium by the dots; and a main curing device which radiates ultraviolet light having at least a wavelength in the second wavelength range, onto the image which has undergone intermediate processing by the intermediate processing device.

9 Claims, 16 Drawing Sheets

FIG.9

$A_1$ INITIATOR A, BEFORE RELEASE OF RADICALS $A_2$ INITIATOR A, AFTER RELEASE OF RADICALS $B_1$ INITIATOR B, BEFORE RELEASE OF RADICALS $B_2$ INITIATOR B, AFTER RELEASE OF RADICALS $C_1$ POLYMERIZABLE COMPOUND, BEFORE POLYMERIZATION (MONOMER)

$C_2$ POLYMERIZABLE COMPOUND, AFTER POLYMERIZATION (POLYMER)

Vn=2

Vn=3

IMAGE FORMING APPARATUS AND IMAGE FORMING METHOD

BACKGROUND OF THE INVENTION

1. Field of the Invention

The present invention relates to an image forming apparatus and an image forming method and more particularly, to an image forming apparatus and an image forming method in which an image is formed by ejecting a light-curable ink from an inkjet head.

2. Description of the Related Art

As an image forming apparatus, an inkjet printer (inkjet recording apparatus) is known, which comprises an inkjet head (liquid droplet ejection head) having an arrangement of a plurality of nozzles (liquid droplet ejection ports) and which forms images on a recording medium by ejecting droplets of ink from the nozzles toward the recording medium while causing the inkjet head and the recording medium to move relatively to each other.

According to an inkjet recording printer, one image is formed on a recording medium by combining ink dots created by ink ejected from the nozzles. In recent years, it has become desirable to form images of high quality on a par with photographic prints, by inkjet printers. It has been thought that high image quality can be achieved, for example, by reducing the size of the ink droplets ejected from the nozzles by reducing the diameter of the nozzles and increasing the number of pixels per unit surface area by arranging the nozzles at high density.

On the other hand, the apparatus becomes larger in size if the nozzles are arranged at high density and a large number of nozzles are provided, and therefore it is also necessary to reduce the size of the apparatus. Furthermore, since inkjet recording apparatuses which require special paper place limitations on the recording medium that can be used, there have also been demands to achieve high-quality image recording, regardless of the type of recording medium.

For example, Japanese Patent Application Publication No. 2004-42548 discloses technology in which, in a case where a recording medium is conveyed by a medium conveyance belt which is wound around a drive roller and an idle roller, or the recording medium is conveyed by rotating the recording medium in a wound state around the surface of a rotating drum, and ultraviolet-curable ink is ejected at prescribed staggered timings from different nozzles, thereby recording dots onto the recording medium. After that, ultraviolet light is radiated onto the dots of ultraviolet-curable ink ejected from the nozzles onto the recording medium, in accordance with the ejection timings, thereby raising the viscosity of the ink and pre-curing the ink to a level whereby adjacent dots do not mix with each other. Then ultraviolet light is radiated again so as to perform main curing, thereby preventing bleeding (landing interference).

Furthermore, for example, Japanese Patent Application Publication No. 2003-251910 discloses an inkjet recording method in which, when printing is performed onto a substrate by ejecting ink that is curable by at least one of either irradiation of radiation or heat energy, from a recording head having at least one nozzle capable of selective control of the ejection of ink droplets, an ink containing two or more types of photoinitiator of different light absorption wavelengths is used, and furthermore, when the ink is cured by the irradiation of radiation, the irradiation is divided into two stages using different wavelengths or intensities, in order to improve the adhesion and the conformity of the ink film with respect to the substrate, and in particular, two or more types of initiator having different light absorption wavelengths are used conjointly.

Moreover, Japanese Patent Application Publication No. 2001-129982 discloses an inkjet printer in which, when paper is conveyed via a rotating drum and ink is ejected from an inkjet head, if there are ink dots to be ejected which are mutually adjacent, then within a plurality of ink ejections, a previously established ejection waiting time (for example, the time required for one rotation of the drum) is inserted before ink ejection for a dot which is adjacent in the main scanning direction or the sub-scanning direction is performed.

Furthermore, Japanese Patent Application Publication No. 2001-1512 discloses an inkjet printer which comprises: an image forming unit that ejects ink onto sheet-shaped paper (printed object); and a pressurizing unit which pressurizes the printed object on which an image has been formed by means of the image forming unit. Such a printer is constituted in such a manner that a luster is applied to the image by pressurizing and flattening the surface undulations of the ink of the image formed on the printed object by the image forming unit.

However, in the related art technology described above, there are still problems when high-quality recording is performed at high speed, onto any desired recording medium.

For example, in the technology described in Japanese Patent Application Publication No. 2004-42548, droplets of an ultraviolet-curable ink are ejected onto a rotating drum and pre-cured (semi-cured), separately for each color, and main curing is carried out after droplet ejection and pre-curing has been completed for all of the colors; however, since the droplets of the ultraviolet-curable ink are ejected directly onto a recording medium wound around a rotating drum, then the ink which has not yet been pre-cured permeates into the recording medium immediately after droplet ejection, and hence bleeding may occur, depending on the type of recording medium used.

Furthermore, according to the inkjet printer in Japanese Patent Application Publication No. 2001-1512, a luster is applied to the image by pressurizing and flattening the surface undulations of the ink of the image, in respect of the dots formed by ultraviolet-curable ink; however, when this flattening process is carried out, the ink curing reaction of the droplets of the previously ejected color can be in a fully cured state, and problems may occur, such as peeling or cracking of the ink surface, during the pressurization and flattening process.

Furthermore, one possible method for forming images in order to obtain high-quality recording on any desired medium, regardless of the permeability of the recording medium, is an intermediate transfer method; however, in consideration of the required transfer characteristics of ultraviolet-curable ink onto the recording medium, it is necessary to maintain a semi-cured state until the ink deposited on the intermediate transfer drum has been transferred onto the recording medium.

Furthermore, in order to prevent landing interference and to prevent complication of the control system, it is necessary to eject droplets onto the intermediate transfer drum and semi-cure the droplets, separately for each color; however, the ink curing reaction of the previously ejected droplets progresses and they achieve a fully cured state, and therefore such transfer becomes impossible.

For example, if an intermediate transfer method based on a rotating drum is applied in the system described in Japanese Patent Application Publication No. 2004-42548, then the curing reaction can proceed too far in the semi-curing process, and the ink can reach a fully cured state, thus giving rise to transfer errors. In particular, if droplets of an ultraviolet-curable ink are ejected onto a rotating drum separately for each color, then there is a possibility that the curing reaction of the ultraviolet-curable ink deposited previously onto the rotating drum progresses and leads to main curing.

Moreover, according to the inkjet recording method described in Japanese Patent Application Publication No. 2003-251910, the ink contains two types of initiators of different light absorption wavelengths, and light is radiated in two stages by means of two types of ultraviolet light sources having different wavelengths; however, the object of this method is to improve the adhesion and compliance of the ink film with respect to the substrate, rather than preventing landing interference and guaranteeing transferability. Furthermore, the inkjet printer described in Japanese Patent Application Publication No. 2001-129982 does not aim to achieve both high-quality recording and high-speed recording. Neither Japanese Patent Application Publication No. 2003-251910 nor Japanese Patent Application Publication No. 2001-129982 achieve high-quality image recording at high speed on any recording medium, regardless of the permeability of the recording medium, by means of an intermediate transfer method.

SUMMARY OF THE INVENTION

The present invention is contrived in view of the aforementioned circumstances, an object thereof being to provide an image forming apparatus where an ink that is curable by application of energy, such as an ultraviolet-curable ink, or a phase-changing ink such as solid ink, is used in order to achieve image fixing having a lustrous effect, to prevent peeling or cracking of the ink surface, and to prevent deterioration of image quality due to color mixing between inks of different colors when a color image is formed. It is another object of the present invention to provide an intermediate transfer type of image forming apparatus and image forming method where landing interference and bleeding with respect to various types of recording media are prevented and the transferability is improved in order to achieve high-quality recording at high speed.

In order to attain the aforementioned object, the present invention is directed to an image forming apparatus, comprising: a plurality of ejection heads which eject liquid containing, a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, an ultraviolet-polymerizable compound, and a coloring material, onto a medium; a semi-curing device which radiates, at least once, ultraviolet light having at least a wavelength which is in the first wavelength range and which is on a longer wavelength side from the second wavelength range, onto dots formed by the liquid ejected from the ejection heads onto the medium; an intermediate processing device which performs intermediate processing of an image formed on the medium by the dots; and a main curing device which radiates ultraviolet light having at least a wavelength in the second wavelength range, onto the image which has undergone intermediate processing by the intermediate processing device.

According to this aspect of the present invention, an ultraviolet curing initiator, a polymerizable compound and a coloring material (e.g. ink) are ejected from one head, and each dot contains the first and the second ultraviolet curing initiators. Accordingly, even if the dots receive irradiation by the semi-curing device a plurality of times, it is possible to carry out intermediate processing while the ultraviolet-curable liquid is maintained in a semi-cured state on the medium. Therefore, even when a color image is formed, for example, it is possible to prevent deterioration of image quality due to color mixing between liquids of different colors, and hence the image can be fixed reliably at high quality.

In order to attain the aforementioned object, the present invention is also directed to an image forming apparatus, comprising: at least one first ejection head which ejects liquid containing, a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, onto a medium; a plurality of second ejection heads which eject liquid containing an ultraviolet-polymerizable compound and a coloring material onto the medium; a semi-curing device which radiates, at least once, ultraviolet light having at least a wavelength which is in the first wavelength range and which is on a longer wavelength side from the second wavelength range, onto dots formed by the liquids ejected from the first and second ejection heads onto the medium; an intermediate processing device which performs intermediate processing of an image formed on the medium by the dots; and a main curing device which radiates ultraviolet light having at least a wavelength in the second wavelength range, onto the image which has undergone intermediate processing by the intermediate processing device.

According to this aspect of the present invention, an ultraviolet curing initiator is ejected from one head, and a polymerizable compound and a coloring material are ejected from a different head, and each dot contains a first and a second ultraviolet curing initiator. Accordingly, even if the dots receive irradiation by the semi-curing device a plurality of times, it is possible to carry out intermediate processing while the ultraviolet-curable liquid is maintained in a semi-cured state on the medium. Therefore, it is possible to form an image of high quality at high speed.

In order to attain the aforementioned object, the present invention is also directed to an image forming apparatus, comprising: at least one third ejection head which ejects liquid containing an ultraviolet-polymerizable compound onto a medium; a plurality of fourth ejection heads which eject liquid containing, a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, and a coloring material, onto the medium; a semi-curing device which radiates, at least once, ultraviolet light having at least a wavelength which is in the first wavelength range and which is on a longer wavelength side from the second wavelength range, onto dots formed by the liquids ejected from the third and fourth ejection heads onto the medium; an intermediate processing device which performs intermediate processing of an image formed on the medium by the dots; and a main curing device which radiates ultraviolet light having at least a wavelength in the second wavelength range, onto the image which has undergone intermediate processing by the intermediate processing device.

According to this aspect of the present invention, a polymerizable compound is ejected from one head, and an ultraviolet curing initiator and a coloring material are ejected from a different head, and each dot contains a first and a second ultraviolet curing initiator. Accordingly, even if the dots receive irradiation by the semi-curing device a plurality of times, it is possible to carry out intermediate processing while the ultraviolet-curable liquid is maintained in a semi-cured state on the medium. Therefore, it is possible to form an image of high quality at high speed.

In the above aspects of the present invention, the meaning of "having spectral absorption characteristics at least in a second wavelength range and having no spectral absorption characteristics in the first wavelength range" includes a mode shown in FIG. 8 described below, for example, in which the absorption of a material B with respect to the first wavelength range $\alpha$ is not completely zero, but is approximately 5% or less (and more desirably, approximately 1% or less) based on the absorption with respect to the second wavelength range $\beta$.

Furthermore, in the above aspects of the present invention, "a semi-curing device which radiates, at least once, ultraviolet light having at least a wavelength which is in the first wavelength range and which is on a longer wavelength side from the second wavelength range, onto dots" includes a mode in which the irradiation intensity of the semi-curing device with respect to the second wavelength range $\beta$ is not completely zero, but is approximately 5% or less (and more desirably, approximately 1% or less) based on the irradiation intensity of the ultraviolet light irradiation with respect to the first wavelength range $\alpha$.

Preferably, a combination ratio of the first ultraviolet curing initiator, the second ultraviolet curing initiator and the ultraviolet polymerizable compound contained in the liquid containing the coloring material corresponding to one color is a combination ratio whereby the liquid is in a semi-cured state even when the liquid is irradiated with the ultraviolet light a plurality of times by the semi-curing device, and the liquid achieves a fully cured state if the liquid is irradiated with the ultraviolet light by the main curing device.

According to this aspect of the present invention, it is possible to perform the intermediate processing reliably while the dots are maintained in a semi-cured state, even if the dots receive irradiation a plurality of times by the semi-curing device.

Preferably, if a mixed liquid droplet is formed by ejecting a droplet from the first head and ejecting a droplet from the second heads onto the medium, a combination ratio of the first ultraviolet curing initiator, the second ultraviolet curing initiator and the polymerizable compound contained in the mixed liquid droplet, is a combination ratio whereby the liquid is in a semi-cured state even when the liquid is irradiated with the ultraviolet light a plurality of times by the semi-curing device and the liquid achieves a fully cured state if the liquid is irradiated with the ultraviolet light by the main curing device.

Preferably, if a mixed liquid droplet is formed by ejecting a droplet from the third head and ejecting a droplet from the fourth heads onto the medium, a combination ratio of the first ultraviolet curing initiator, the second ultraviolet curing initiator and the polymerizable compound contained in the mixed liquid droplet, is a combination ratio whereby the liquid is in a semi-cured state even when the liquid is irradiated with the ultraviolet light a plurality of times by the semi-curing device and the liquid achieves a fully cured state if the liquid is irradiated with the ultraviolet light by the main curing device.

Preferably, the intermediate processing device is a smoothing device which smoothes the liquid on the medium.

According to this aspect of the present invention, since the liquid (e.g. ink) in the semi-cured state is relatively flexible and easily deformable, then if the undulations in the liquid surface are flattened by the smoothing device while the liquid is in this semi-cured state, then it is possible to eliminate a sense of non-uniformity in the surface caused by differences in the amount of overlap of the liquid.

Preferably, the smoothing device includes a pressurizing device which applies pressure to the coloring material on the medium.

According to this aspect of the present invention, it is possible to smooth the liquid surface reliably, and in particular, it becomes possible to smooth the liquid in a flexible and semi-cured state. Therefore, it is possible to prevent peeling and cracking of the liquid surface during pressurization and flattening.

Preferably, the smoothing device includes a heating device which heats the coloring material on the medium.

According to this aspect of the present invention, it is possible to achieve smoothing by means of only the pressurization device which pressurizes the liquid, without using a heating device; however, according to a composition combining a heating device and a pressurization device is adopted, it is possible to achieve more efficient smoothing, depending on the type of liquid and recording medium. For example, if liquid of a type which proceeds to harden when applied with heat is used, then it is possible to promote a curing reaction while flattening advances, and hence the energy applied by the main curing device can be reduced.

Preferably, the image forming apparatus further comprises a control device which controls at least one of a smoothing condition of the smoothing device and energy radiated by the semi-curing device, according to at least one of the a type of the medium, a type of the liquid and an amount of the liquid deposited onto the medium.

The "type of the medium" can be identified in terms of the material, size, thickness, reflectivity, adhesion characteristics, permeability, or the like. The device which ascertains the type of medium is not limited to a device (detection device) that actually measures the width or reflectivity of the medium, and it is also possible to adopt a composition in which the type of medium used is identified automatically, and the characteristics of media are ascertained by referring to a data table arranged according to media types. Furthermore, a composition may also be adopted in which the type or thickness of the medium used is input by a user operating a prescribed input device, or the like.

For a device which acquires information on the liquid (e.g. ink) type, it is possible to use, for example, a device which reads in liquid properties information from the shape of the cartridge in the liquid tank (a specific shape representing the liquid type), or from a bar code or IC chip incorporated into the cartridge. Besides this, it is also possible to adopt a composition in which the required information is input by an operator, using a prescribed input device (user interface).

The "amount of liquid deposited" can be ascertained from information relating to the liquid ejection volume, on the basis of the image data that is to be printed. By controlling conditions in such a manner that a suitable flattening process or semi-solid solution forming process is performed on the basis of the conditions relating to the print, it is possible to prevent peeling and cracking of the liquid that occurs in the event of excessive flattening, and hence even more suitable image fixing can be achieved.

Preferably, the medium is an intermediate transfer rotating medium; the intermediate processing device is a transfer device which transfers the image formed on the intermediate transfer rotating medium onto a recording medium; and the main curing device radiates the ultraviolet light onto the recording medium.

According to this aspect of the present invention, it is possible to prevent landing interference and bleeding with respect to a variety of recording media, and to improve transferability, thereby making it possible to achieve high-quality recording at high speed.

The image forming apparatus further comprises: a semi-curing time determination device which determines a semi-curing time of the dots formed on the intermediate transfer rotating medium; a droplet ejection sequence setting device which sets droplet ejection sequence of the dots in a sub-scanning direction corresponding to a direction of rotation of the intermediate transfer rotating medium and a main scanning direction being perpendicular to the sub-scanning direction, according to at least a degree of overlap between the dots in an oblique direction which is inclined with respect to the sub-scanning direction; and a droplet ejection timing differential setting device which sets a droplet ejection timing differential between the dots which are adjacent to and overlap with each other in such a manner that the droplet ejection timing differential between the dots which are adjacent to each other is not less than the semi-curing time of the dots.

According to this aspect of the present invention, it is possible to set an optimal droplet ejection sequence for achieving high-speed and high-quality recording in order to prevent the occurrence of landing interference.

In order to attain the aforementioned object, the present invention is also directed to an image forming method, comprising the steps of: ejecting a liquid containing a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, an ultraviolet-polymerizable compound and a coloring material, onto a medium from a plurality of ejection heads; radiating, at least once, ultraviolet light having at least a wavelength which is in the first wavelength range and which is on a longer wavelength side from the second wavelength range, onto dots formed by the liquid ejected onto the medium in such a manner that semi-curing is performed; applying intermediate processing to an image formed by the dots which are semi-cured on the medium; and radiating ultraviolet light having at least a wavelength in the second wavelength range, onto the image which has undergone the intermediate processing in such a manner that main curing is performed.

According to this aspect of the present invention, an ultraviolet curing initiator, a polymerizable compound and a coloring material (e.g. ink) are ejected from one head, and each dot contains the first and the second ultraviolet curing initiators. Accordingly, even if the dots receive irradiation by the semi-curing device a plurality of times, it is possible to carry out intermediate processing while the ultraviolet-curable liquid is maintained in a semi-cured state on the medium. Therefore, even when a color image is formed, for example, it is possible to prevent deterioration of image quality caused by color mixing between liquids of different colors, and hence the image can be fixed reliably at high quality.

In order to attain the aforementioned object, the present invention is also directed to an image forming method, comprising the steps of: ejecting liquid containing a first ultraviolet curing initiator having spectral absorption characteristics at least in a first wavelength range, and a second ultraviolet curing initiator which has spectral absorption characteristics at least in a second wavelength range being on a shorter wavelength side from the first wavelength range and has no spectral absorption characteristics in the first wavelength range, onto a medium selectively from at least one first ejection head; ejecting liquid containing an ultraviolet-polymerizable compound and a coloring material onto the medium, selectively from a plurality of second ejection heads; radiating, at least once, ultraviolet light having at least a wavelength which is in the first wavelength range and which is on a longer wavelength side from the second wavelength range, onto dots formed by the liquids ejected from the first and second ejection heads onto the medium in such a manner that semi-curing is performed; applying intermediate processing to an image formed by the dots which are semi-cured on the medium; and radiating ultraviolet light having at least a wavelength in the second wavelength range, onto the image which has undergone the intermediate processing in such a manner that main curing is performed.

According to this aspect of the present invention, an ultraviolet curing initiator is ejected from one head, a polymerizable compound and a coloring material are ejected from a different head, and each dot contains a first and a second ultraviolet curing initiator. Accordingly, even if the dots receive irradiation by the semi-curing device a plurality of times, it is possible to carry out intermediate processing while the ultraviolet-curable liquid is maintained in a semi-cured state on the medium. Therefore, it is possible to form an image of high quality at high speed.

In order to attain the aforementioned object, the present invention is also directed to an image forming method, comprising the steps of: ejecting liquid containing an ultraviolet-polymerizable compound onto a medium selectively from at least one third ejection head; ejecting a liquid containing a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, and a coloring material, onto the medium selectively from a plurality of fourth ejection heads; radiating, at least once, ultraviolet light having at least a wavelength which is in the first wavelength range and which is on a longer wavelength side from the second wavelength range, onto dots formed by the liquids selectively ejected from the third and fourth ejection heads onto the medium in such a manner that semi-curing is performed; applying intermediate processing to an image formed by the dots which are semi-cured on the medium; and radiating ultraviolet light having at least a wavelength in the second wavelength range, onto the image which has undergone the intermediate processing in such a manner that main curing is performed.

According to this aspect of the present invention, a polymerizable compound is ejected from one head, an ultraviolet curing initiator and a coloring material are ejected from a different head, and each dot contains a first and a second ultraviolet curing initiator. Accordingly, even if the dots receive irradiation by the semi-curing device a plurality of times, it is possible to carry out intermediate processing while the ultraviolet-curable liquid is maintained in a semi-cured state on the medium. Therefore, it is possible to form an image of high quality at high speed.

In the above aspects of the present invention, the meaning of "having spectral absorption characteristics at least in a second wavelength range and having no spectral absorption characteristics in the first wavelength range" includes a mode shown in FIG. 8 described below, for example, in which the absorption of a material B with respect to the first wavelength range $\alpha$ is not completely zero, but is approximately 5% or less (and more desirably, approximately 1% or less) based on the absorption with respect to the second wavelength range $\beta$.

Furthermore, in the above aspects of the present invention, the meaning of "radiating, at least once, ultraviolet light having at least a wavelength which is in the first wavelength range and which is on a longer wavelength side from the second wavelength range, onto dots formed by the liquid ejected onto the medium in such a manner that semi-curing is performed" includes a mode in which the irradiation intensity of the ultraviolet light irradiation for semi-curing with respect to the second wavelength range $\beta$ is not completely zero, but is approximately 5% or less (and more desirably, approximately 1% or less) based on the irradiation intensity of the ultraviolet light irradiation with respect to the first wavelength range $\alpha$.

As described above, according to the present invention, it is possible to carry out intermediate processing while the ultraviolet-curable liquid is maintained in a semi-cured state on the medium. When a color image is formed, for example, it is possible to prevent image deterioration caused by the color mixing between liquids (e.g. inks) of different colors, and hence reliable image fixing at high quality can be achieved. Furthermore, if an intermediate transfer rotating medium is used as a medium, then it is possible to reliably transfer the ultraviolet-curable liquid in a semi-cured state on the intermediate transfer rotating medium, to the recording medium, and hence it is possible to form an image of high quality at high speed, onto various types of recording media.

BRIEF DESCRIPTION OF THE DRAWINGS

The nature of this invention, as well as other objects and benefits thereof, are explained in the following with reference to the accompanying drawings, wherein:

FIG. 9 is an illustrative diagram of symbols for describing a polymerization reaction by means of a curing initiator;

DETAILED DESCRIPTION OF THE PREFERRED EMBODIMENTS

Figure 1:
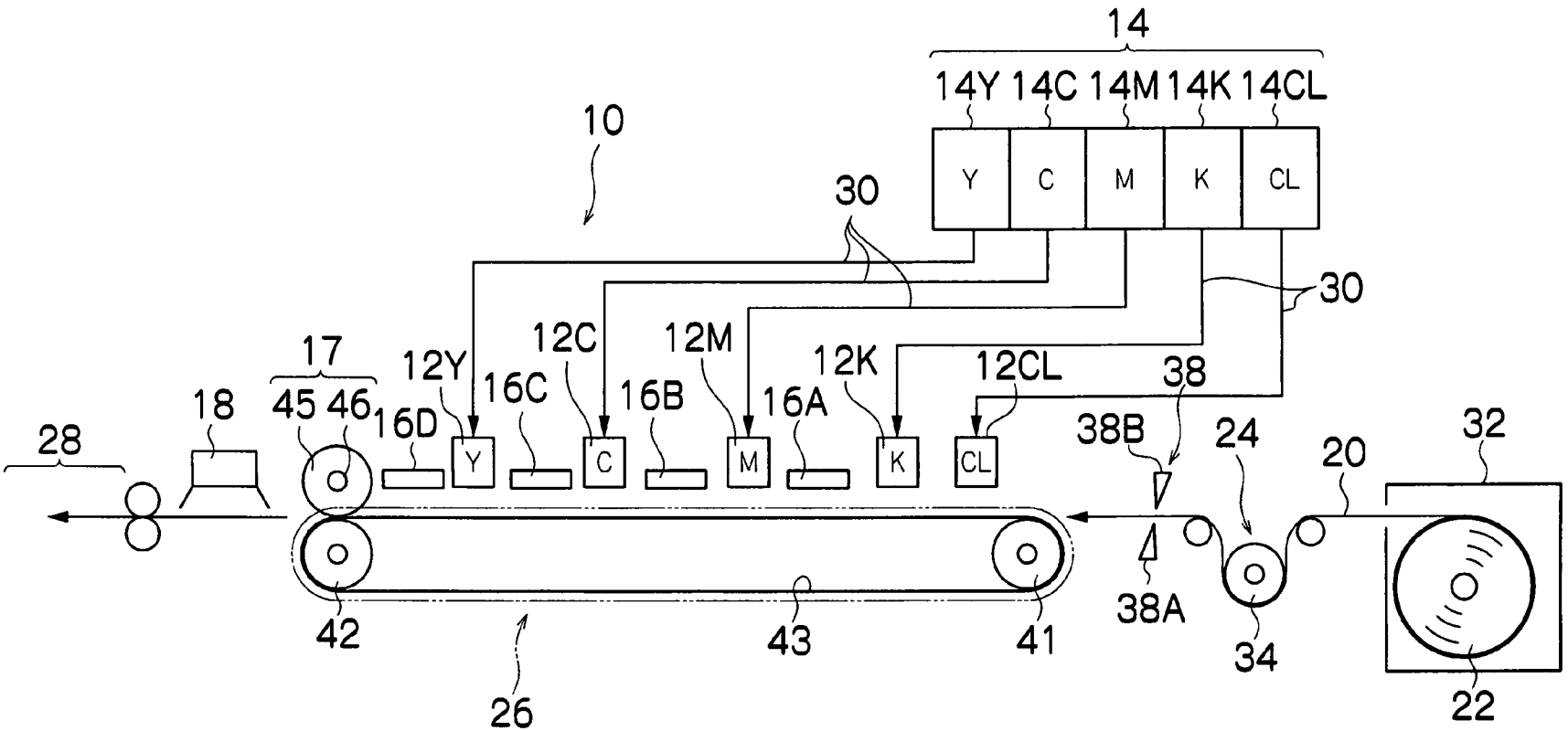
FIG. 1 is a general schematic drawing of an image forming apparatus relating to a first embodiment of the present invention.

FIG. 1 shows a general schematic drawing of an image forming apparatus relating to an embodiment of the present invention. As shown in FIG. 1, this inkjet recording apparatus 10 comprises: a plurality of inkjet heads (hereafter, also called "heads") 12CL, 12K, 12C, 12M and 12Y provided corresponding to respective ink colors, namely, clear (transparent: CL), black (K), magenta (M), cyan (C) and yellow (Y); an ink storing and loading unit 14 for storing ultraviolet curable ink (so-called "ultraviolet ink") to be supplied to the heads 12CL, 12K, 12C, 12M and 12Y; semi-solid solution forming light sources (semi-curing light sources) 16A, 16B, 16C and 16D disposed respectively on the downstream side of each head (after each head); a pressurizing and fixing unit 17 disposed downstream of the semi-solid solution forming light source 16D following the last head (the yellow head 12Y) (after the semi-solid solution forming light source 16D); a main curing unit 18 disposed after the pressurizing and fixing unit 17; a paper supply unit 22 for supplying recording paper 20 forming a recording medium; a decurling unit 24 for removing curl in the recording paper 20; a suction belt conveyance unit 26, disposed facing the nozzle faces (ink ejection faces) of the heads 12CL, 12K, 12C, 12M and 12Y and the light emitting faces of the semi-solid solution forming light sources (semi-curing light sources) 16A to 16D, for conveying the recording paper 20 while keeping the recording paper 20 flat; and a paper output unit 28 for outputting recorded recording paper (printed matter) to the exterior.

The ultraviolet curable ink is an ink containing a polymerization initiator and a component which hardens (polymerizes) upon application of ultraviolet energy (namely, an ultraviolet-setting component, such as a monomer, oligomer, a low-molecular-weight homopolymer, copolymer, or the like). The ink therefore has a property whereby, when the ink is irradiated with ultraviolet light, it starts to polymerize and as the polymerization progress, the viscosity of the ink increases and finally it hardens. The materials of the initiator are described in detail in the second embodiment.

In the first embodiment, an initiator is loaded into the head 12CL as a clear liquid, whereas a polymerizable compound and coloring materials of the colors K, M, C and Y are loaded into the heads 12K, 12M, 12C and 12Y. In this way, by loading an initiator and a polymerizable compound to different heads, then even if reflected ultraviolet light from the semi-solid solution forming light sources 16A to 16D enters the nozzles of the head, it is still possible to prevent blockages caused by curing inside the nozzles. Furthermore, such clear liquid heads 12CL may also be positioned immediately on the upstream side of each of the color heads 12K, 12M, 12C and 12Y (immediately before each of the color heads 12K, 12M, 12C and 12Y).

Apart from the composition described above, it is also possible to adopt a mode in which a polymerizable compound forming a clear liquid is loaded into the clear liquid head 12CL, whereas an initiator and coloring materials of the respective colors, K, M, C and Y, are loaded into the heads 12K, 12M, 12C and 12Y. Moreover, a mode is also possible in which an initiator, a polymerizable compound, and a coloring material, such as colors, K, M, C and Y, are all loaded into each of the heads 12K, 12M, 12C and 12Y. In this case, a clear liquid head 12CL is not provided.

The ink storing and loading unit 14 has ink tanks 14CL, 14K, 14M, 14C and 14Y for storing the inks of the colors (including a transparent color) corresponding to the print heads 12CL, 12K, 12C, 12M and 12Y, and the tanks are connected to the print heads 12CL, 12K, 12C, 12M and 12Y through prescribed channels 30. The ink storing and loading unit 14 has a warning device (for example, a display device or an alarm sound generator) for warning when the remaining amount of any ink is low, and has a mechanism for preventing loading errors among the colors. Here, the clear head 12CL does not apply color points during formation of a color image, but rather it applies clear ink taking account of the amount of ink deposited by the other colored inks (K, M, C, Y), in such a manner that the amount of ink deposited at each printing point is approximately uniform.

In FIG. 1, a magazine for rolled paper (continuous paper) is shown as an example of the paper supply unit 22; however, more magazines 32 with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 20 delivered from the paper supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording paper 20 has a curl in which the surface on which the print is to be made is slightly round outward.

In the case of the configuration in which roll paper is used, a cutter 38 is provided as shown in FIG. 1, and the continuous paper is cut into a desired size by the cutter 38. The cutter 38 has a stationary blade 38A, whose length is not less than the width of the conveyor pathway of the recording paper 20, and a round blade 38B, which moves along the stationary blade 38A. The stationary blade 38A is disposed on the reverse side of the printed surface of the recording paper 20, and the round blade 38B is disposed on the printed surface side across the conveyor pathway. When cut papers are used, the cutter 38 is not required.

After decurling in the decurling unit 24, the cut recording paper 20 is delivered to the suction belt conveyance unit 26. The suction belt conveyance unit 26 has a configuration in which an endless belt 43 is set around rollers 41 and 42 in such a manner that at least the portion of the endless belt 43 facing the nozzle faces of the print heads 12CL, 12K, 12M, 12C and 12Y forms a plane (flat plane).

The belt 43 has a width that is greater than the width of the recording paper 20, and a plurality of suction apertures (not shown) are formed on the belt surface. A suction chamber (not illustrated) is provided on the inner side of the belt 43 set about the rollers 41 and 42, and the recording paper 20 is suctioned and held on the belt 43 by creating a negative pressure by suctioning the suction chamber with a fan.

The belt 43 is driven in the anti clockwise direction in FIG. 1 by the motive force of a motor 134 (not shown in FIG. 1, but shown in FIG. 6) being transmitted to at least one of the rollers 41 and 42, which the belt 43 is set around, and the recording paper 20 held on the belt 43 is conveyed from right to left in FIG. 1.

The heads 12CL, 12K, 12M, 12C and 12Y are full line heads having a length corresponding to the maximum width of the recording paper 20 used with the image forming apparatus 10, and comprising a plurality of nozzles for ejecting ink arranged on a nozzle face through a length exceeding at least one edge of the maximum-size recording paper 20 (namely, the full width of the printable range).

The heads 12CL, 12K, 12C, 12M and 12Y are arranged in color order (clear (CL), black (K), magenta (M), cyan (C) and yellow (Y)) from the upstream side in the delivery direction of the recording paper 20, and these respective heads 12CL, 12K, 12M, 12C and 12Y are fixed extending in a direction substantially perpendicular to the conveyance direction of the recording paper 20. In this head arrangement sequence, the heads are arranged in order of ascending curing sensitivity, from the upstream side towards the downstream side.

A color image can be formed on the recording paper 20 by ejecting inks of different colors from the print heads 12CL, 12K, 12C, 12M and 12Y, respectively, onto the recording paper 20 while the recording paper 20 is conveyed by the suction belt conveyance unit 26. The clear ink serves to maintain the flatness of the ink surface and it is ejected onto regions where no colored ink has been deposited, or regions where only a small amount of colored ink has been deposited.

By adopting a configuration in which full line heads 12CL, 12K, 12M, 12C and 12Y having nozzle rows covering the full paper width are provided for each separate color in this way, it is possible to record an image on the full surface of the recording paper 20 by performing just one operation of moving the recording paper 20 relatively with respect to the heads 12K, 12M, 12C and 12Y in the paper conveyance direction (the sub-scanning direction), (in other words, by means of one sub-scanning action). A single pass image forming apparatus 10 of this kind is able to print at high speed in comparison with a shuttle scanning system in which an image is printed by moving a recording head back and forth reciprocally in the main scanning direction, and hence print productivity can be improved.

Although a configuration with the four standard colors K, C, M, Y and clear ink (CL) is described in the present embodiment, the combinations of the ink colors and the number of colors are not limited to these. Light and/or dark inks can be added as required. For example, a configuration is possible in which inkjet heads for ejecting light-colored inks such as light cyan and light magenta are added.

The semi-solid solution forming light sources 16A to 16D, which are disposed on the downstream side of the heads respectively, have a length corresponding to the maximum width of the recording paper 20, similarly to the heads, and they are fixed extending in a direction substantially perpendicular to the conveyance direction of the recording paper 20. LED elements or LD elements having a narrow light emission waveband compared to the main curing light source 18 are suitable for use in the semi-solid solution forming light sources 16A to 16D. Here, the central wavelength and the light emission waveband of the semi-solid solution forming light sources 16A to 16D and the main curing light source 18 are selected in accordance with the design specifications of the ink used.

Each of the semi-solid solution forming light sources 16A to 16D radiates ultraviolet having an energy sufficient to cause the ink deposited by the head 12K, 12M, 12C, 12Y or 12CL positioned adjacently on the upstream side thereof, to change to a semi-solid solution state (namely, a state where the ink has a viscosity which prevents the occurrence of color mixing even in the case of contact with ink of another color).

More specifically, the semi-solid solution forming light sources 16A to 16D have the function of changing the state of ink that has been deposited onto the recording paper 20 by a preceding head 12CL, 12K, 12M, 12C or 12Y, to a pliable (deformable) ink state that is not equivalent to full curing, and they also have the function of semi-curing the ink on the recording paper 20 to a degree where the ink is prevented from mixing with ink of a different color ejected from a subsequent head 12K, 12M, 12C or 12Y, and hence the occurrence of color bleeding is prevented.

When the recording paper 20 has passed under an upstream head and before it passes below the next head, light is radiated from a semi-solid solution forming light source 16A, 16B, 16C or 16D, thereby changing the state of the ink on the recording paper 20 to a semi-cured state, in such a manner that droplets of a different color can be deposited by the subsequent print head.

In the example shown in FIG. 1, after droplets have been ejected by the clear head 12CL, droplets are ejected by the black head 12K and are passed through the light radiated by the semi-solid solution forming light source 16A, and the droplets of black ink are thereby changed to a semi-solid solution state, whereupon droplets are ejected by the magenta head 12M. Similarly, after ejection of droplets by the magenta head 12M, the droplets pass through light irradiated by the semi-solid solution forming light source 16B, whereupon droplets are ejected by the cyan head 12C, passed through the light irradiated by the semi-solid solution forming light source 16C, and then droplets are ejected by the yellow head 12Y. When droplets have been ejected by the yellow head 12Y, they are irradiated with light from the semi-solid solution forming light source 16D.

Ink ejected from a head positioned towards the upstream side in the conveyance direction of the recording paper 20 is passed more times through a semi-solid solution forming region; however, it becomes possible to maintain the ink on the recording paper 20 in a semi-cured state (semi-solid solution state) due to the spectral absorption sensitivity characteristics of the initiator, described hereinafter. Therefore, when the ink has passed by the last semi-solid solution forming light source 16D, there is little difference in the progress of curing of the inks of different colors on the recording paper 20 and all the inks can be in a uniform semi-solid solution state.

The pressurizing and fixing unit 17 (flattening device) provided after the final semi-solid solution forming light source 16D includes a roller 45 whose surface is coated with a resin having high separation characteristics. The roller 45 has a hollow structure and a heater 46, such as a halogen lamp, is provided in the central portion thereof, in such a manner that the image surface of the recording paper 20 is heated while being pressed by the roller 45. By heating and pressing the ink surface by means of the pressurizing and fixing unit 17, the undulations in the ink surface are flattened. Furthermore, if it is possible to flatten the ink surface by pressure alone, without applying heat, then the heating action can be omitted. In cases in which printing is performed with dye-based ink on porous paper, blocking the pores of the paper by the application of pressure prevents the ink from coming into contact with ozone and other substances that cause the dye molecules to break down, and hence it has the effect of increasing the durability of the print.

The pressurizing and fixing unit 17 has a mechanism according to which the applied pressure can be adjusted (for example, it has a structure in which a pressing force by means of the roller 45 is variable by adjusting spring loading), and it is controlled to a suitable pressure in accordance with the thickness of the recording paper 20 and/or the amount of ink.

A main curing light source 18 is provided downstream of the pressurizing and fixing unit 17 (after the pressurizing and fixing unit 17). The main curing light source 18 includes a metal halide lamp or a mercury lamp, or the like, having a broader light emission waveband and a greater irradiation light energy (intensity) than the semi-solid solution forming light sources 16A to 16D.

The recording paper 20 that has undergone a flattening process by the pressurizing and fixing unit 17 is irradiated with light sufficient to cause the ink to harden completely, by the main curing light source 18, and thereby main curing is performed.

Furthermore, the roller 45 of the pressurizing and fixing unit 17 is constituted in such a manner that it can be moved to a prescribed withdrawal position where it does not make contact with the recording paper 20, by means of a movement mechanism (not illustrated). When a flattening process of the ink surface is carried out, pressure is applied by positioning the roller 45 at a prescribed position (flattening process position) where it makes contact with the recording paper 20. On the other hand, if the ink surface does not require a flattening process, then the roller 45 is withdrawn to the withdrawal position, and the ink is cured and fixed by the main curing light source 18, without applying pressure. By this means, it is also possible to form images in which the ink surface remains with undulations.

The device for switching the pressurizing and fixing unit 17 between a pressurizing state and a non-pressurizing state may be a structure which allows the pressurizing and fixing unit 17 to be removed (separated), rather than the withdrawal mechanism described above. In other words, a mode can be adopted in which, if a flattening process is not required, then the pressurizing and fixing unit 17 (or a portion of same) is removed from the image forming apparatus 10 and the flattening process is omitted.

In this way, a printed object is generated by passing through the main curing process of the main curing light source 18 (a process for curing and fixing the ink to such a degree that image degradation due to ink smearing, or the like, would not occur in the process of conveyance) and this printed object is output from the paper output unit 28. Although not shown in FIG. 1, the paper output unit 28 is provided with a sorter for collecting images according to print orders.

The irradiation wavelength ranges of the semi-curing light sources and the main curing light sources are stated in detail in the second embodiment.

Figure 2:
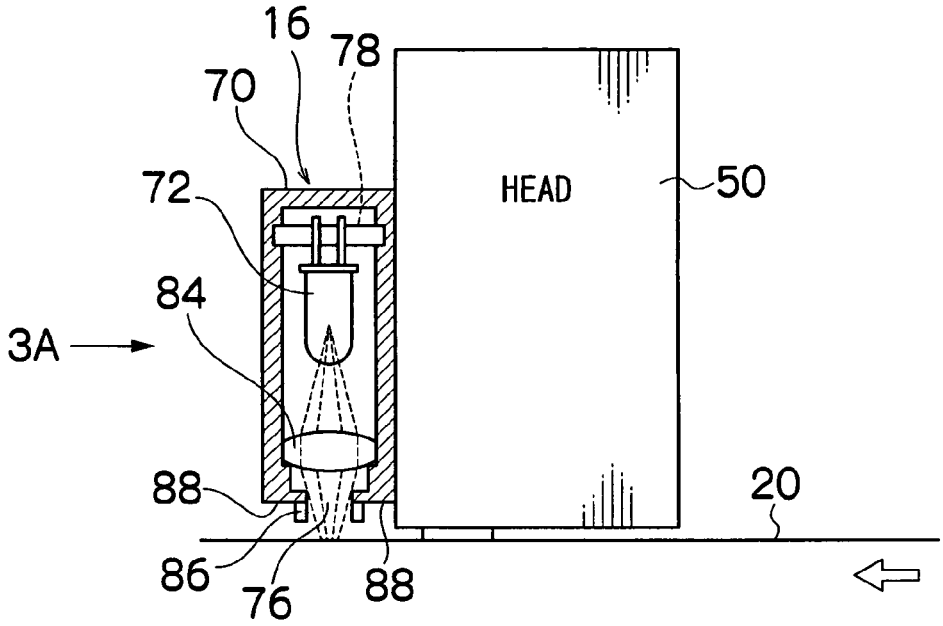
FIG. 2 is a partial cross-sectional diagram showing an example of the detailed structure of a semi-solid solution forming light source.

Next, an example of the structure of a semi-solid solution curing section is described below. The semi-solid solution light sources 16A to 16D have a common structure, and hence a representative example of the light sources is labeled with the reference numeral 16. FIG. 2 is a partial cross-sectional diagram showing an example of the detailed composition of a semi-solid solution forming light source 16, and FIG. 3 is a cross-sectional diagram on a side indicated by an arrow 3A in FIG. 2.

Figure 3:
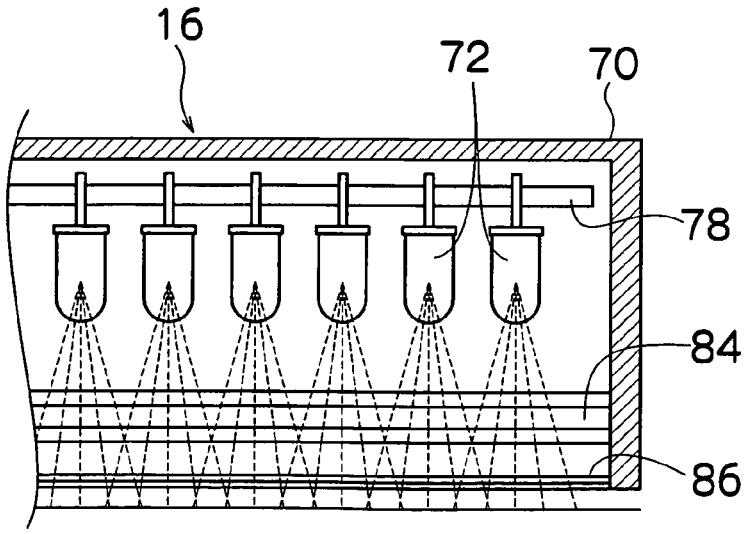
FIG. 3 is a partial cross-sectional diagram viewed in the direction of arrow 3A in FIG. 2.

As shown in FIG. 2 and FIG. 3, the semi-solid solution forming light source 16 has a structure in which a plurality of ultraviolet LED elements 72 are arranged in a linear fashion following the lengthwise direction of the head 50, inside a light shroud 70. A condensing cylindrical lens 84 is disposed below the row of ultraviolet LED elements 72. Reference numeral 78 denotes a substrate by which the ultraviolet LED elements 72 are supported.

A slit-shaped opening 76 forming a light output opening is formed in the base portion of the light shroud 70, and a light-shielding rim 86 which protrudes in the light output direction is provided about the perimeter of the opening section 76. Furthermore, an ultraviolet absorbing coating 88 is provided on the base surface of the light shroud 70 facing the recording paper 20.

Scattered light generated by the group of ultraviolet LED elements 72 is condensed into a linear shape in a direction substantially orthogonal to the paper conveyance direction, by the action of the cylindrical lens 84, and the recording paper 20 is irradiated with the light. Instead of the cylindrical lens 84, it is also possible to use a lens group having one or more non-spherical surface shaped to achieve refraction of the light, having a condensing power equivalent or similar to that of the cylindrical lens 84.

By selectively lighting up the group of ultraviolet LED elements 72 illustrated in FIG. 2 and FIG. 3, and controlling the intensity of light emitted by each element, it is possible to achieve a desired irradiation range and light quantity (intensity) distribution in the irradiation area of the ultraviolet light.

The light emission positions and the emitted light intensities of the ultraviolet LED elements 72 are controlled suitably in accordance with the size of the recording paper 20, the droplet ejection range of the head 50 and the amount of ink from the head, in such a manner that the minimum necessary amount of light is generated, thereby minimizing adverse effects on the head 50 such as the curing of ink inside the nozzles 51.

The composition of the semi-solid solution forming light sources 16 is not limited to one using lamp-type ultraviolet LED elements 72 such as those in FIG. 2 and FIG. 3, and it is also possible to arrange an LED element(s) one-dimensionally on a substrate. Furthermore, a composition using LD (laser diode) elements instead of LED elements may also be adopted.

Next, the control system of the image forming apparatus 10 is described below.

Figure 4:
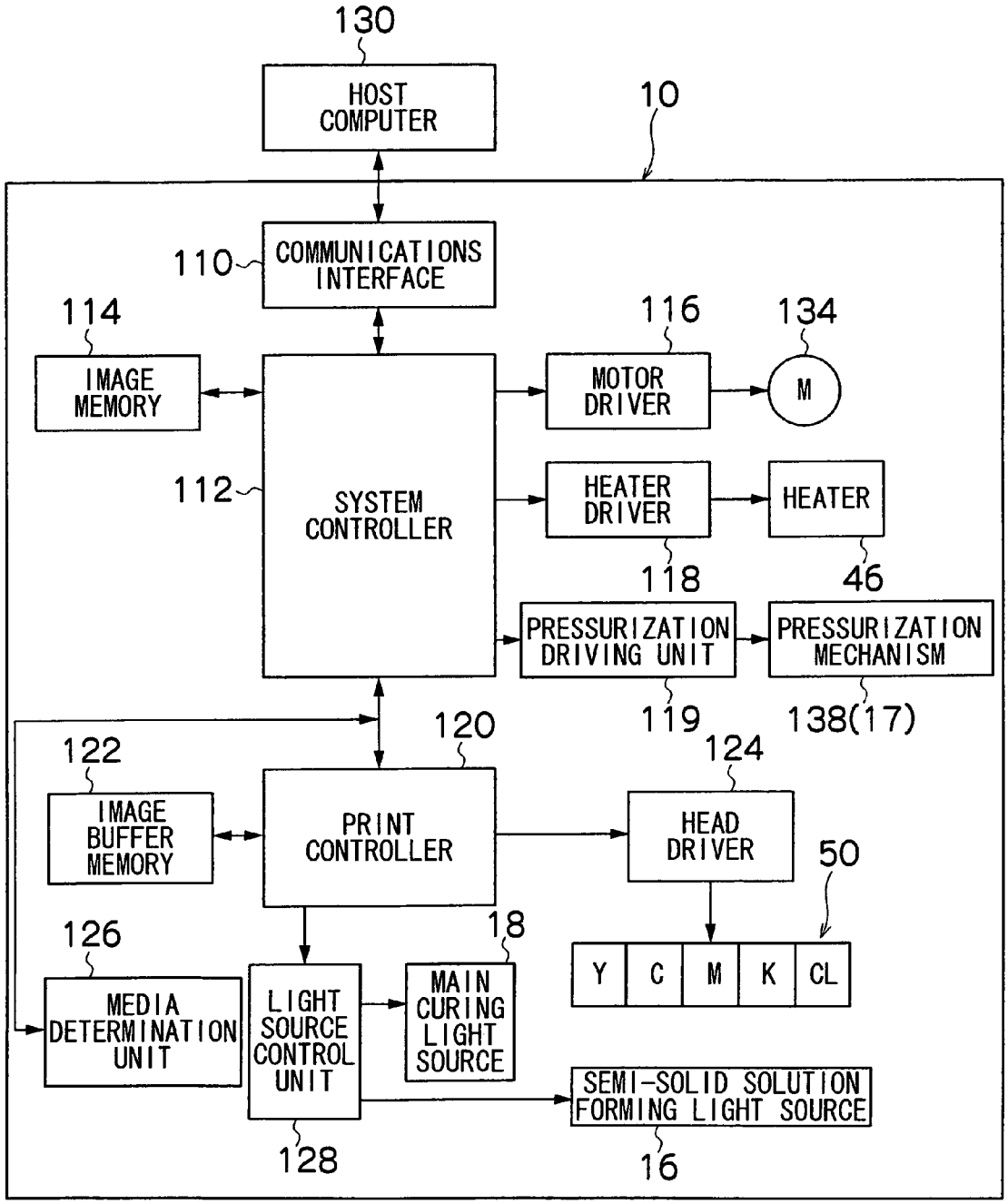
FIG. 4 is a principal block diagram showing the system composition of an image forming apparatus according to an embodiment.

FIG. 4 is a principal block diagram showing the system composition of the inkjet recording apparatus 10. The image forming apparatus 10 comprises a communications interface 110, a system controller 112, an image memory 114, a motor driver 116, a heater driver 118, a pressurization drive unit 119, a print controller 120, an image buffer memory 122, a head driver 124, a media determination unit 126, a light source control unit 128, and the like.

The communications interface 110 is an interface unit for receiving image data transmitted by a host computer 130. For the communications interface 110, a serial interface, such as USB, IEEE 1394, an Ethernet, or a wireless network, or the like, or a parallel interface, such as a Centronics interface, or the like, can be used. It is also possible to install a buffer memory (not illustrated) for achieving high-speed communications. Image data sent from a host computer 130 is read into the image forming apparatus 10 via the communications interface 110, and is stored temporarily in the image memory 114. The image memory 114 is a storage device for temporarily storing an image input via the communications interface 110, and data is written to and read from the image memory 114 via the system controller 112. The image memory 114 is not limited to a memory consisting of a semiconductor element, and a magnetic medium, such as a hard disk, or the like, may also be used.

The system controller 112 is a control unit for controlling the various sections, such as the communications interface 110, the image memory 114, the motor driver 116, the heater driver 118, the pressurization drive unit 119, and the like. The system controller 112 is constituted by a central processing unit (CPU) and peripheral circuits thereof, and the like, and in addition to controlling communications with the host computer 130 and controlling reading and writing from and to the image memory 114, or the like, it also generates control signals for controlling the motor 134 of the conveyance system, the heater 46, the pressurizing mechanism 138 of the pressurizing and fixing unit 17, and the like.

The motor driver 116 is a driver (drive circuit) which drives the motor 134 in accordance with instructions from the system controller 112. The heater driver 118 is a driver which drives the heating drum 34 and the heater 46 inside the roller 45 of the pressurizing and fixing unit 17, as well as other heaters, in accordance with commands from the system controller 112.

The pressurization drive unit 119 is a device which changes the applied pressure by driving the pressurizing mechanism 138 in accordance with commands from the system controller 112, and moves the pressurizing mechanism 138 between the withdrawal position and the flattening process position.

The print controller 120 has a signal processing function for performing various tasks, compensations, and other types of processing for generating print control signals from the image data stored in the image memory 114 in accordance with commands from the system controller 112 so as to supply the generated print control signal (dot data) to the head driver 124. Prescribed signal processing is carried out in the print controller 120, and the ejection amount and the ejection timing of the ink from the respective print heads 50 are controlled via the head driver 124, on the basis of the print data. By this means, prescribed dot size and dot positions can be achieved.

The print controller 120 is provided with the image buffer memory 122; and image data, parameters, and other data are temporarily stored in the image buffer memory 122 when image data is processed in the print controller 120. The example shown in FIG. 4 is one in which the image buffer memory 122 accompanies the print controller 120; however, the image memory 114 may also serve as the image buffer memory 122. Also possible is an aspect in which the print controller 120 and the system controller 112 are integrated to form a single processor.

The head driver 124 drives the actuators 58 which drive ejection in each head 50, on the basis of the dot data supplied from the print controller 120. A feedback control system for maintaining constant drive conditions for the print heads may be included in the head driver 124.

The image data to be printed is externally inputted through the communications interface 110, and is stored in the image memory 114. At this stage, RGB image data is stored in the image memory 114, for example. The image data stored in the image memory 114 is sent to the print controller 120 through the system controller 112, and is converted to the dot data for each ink color in the print controller 120, by a known dithering method, an error diffusion method or another technique.

The print heads 50 are driven on the basis of the dot data thus generated by the print controller 120, so that ink is ejected from the heads 50. By controlling ink ejection of the heads 50 in synchronization with the conveyance speed of the recording paper 20, an image is formed on the recording paper 20.

The media determination unit 126 is a device for determining the type and size of recording paper 20. This section includes, for example, a device for reading in information such as bar codes attached to the magazine 32 in the paper supply unit 22, or sensors disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of an input via a prescribed user interface, instead of or in conjunction with such automatic determination devices.

Information obtained by the media determination unit 126 is sent to the system controller 112 and/or the print controller 120, and is used for controlling ink ejection and for controlling the semi-solid solution forming light sources 16 and the pressurizing mechanism 138, and the like.

The light source control unit 128 includes a semi-solid solution forming light source control circuit for controlling the on and off switching, lighting up positions, light emission intensities, and the like, of the semi-solid solution forming light sources 16; and a main curing light source control circuit for controlling the on and off switching, the light emission intensity, and the like, of the main curing light source 18. The light source control unit 128 controls the light emission of each of the light sources (16, 18) in accordance with commands from the print controller 120.

Next, an example of the control of the image forming apparatus 10 having the foregoing composition is described below.

Figure 5:
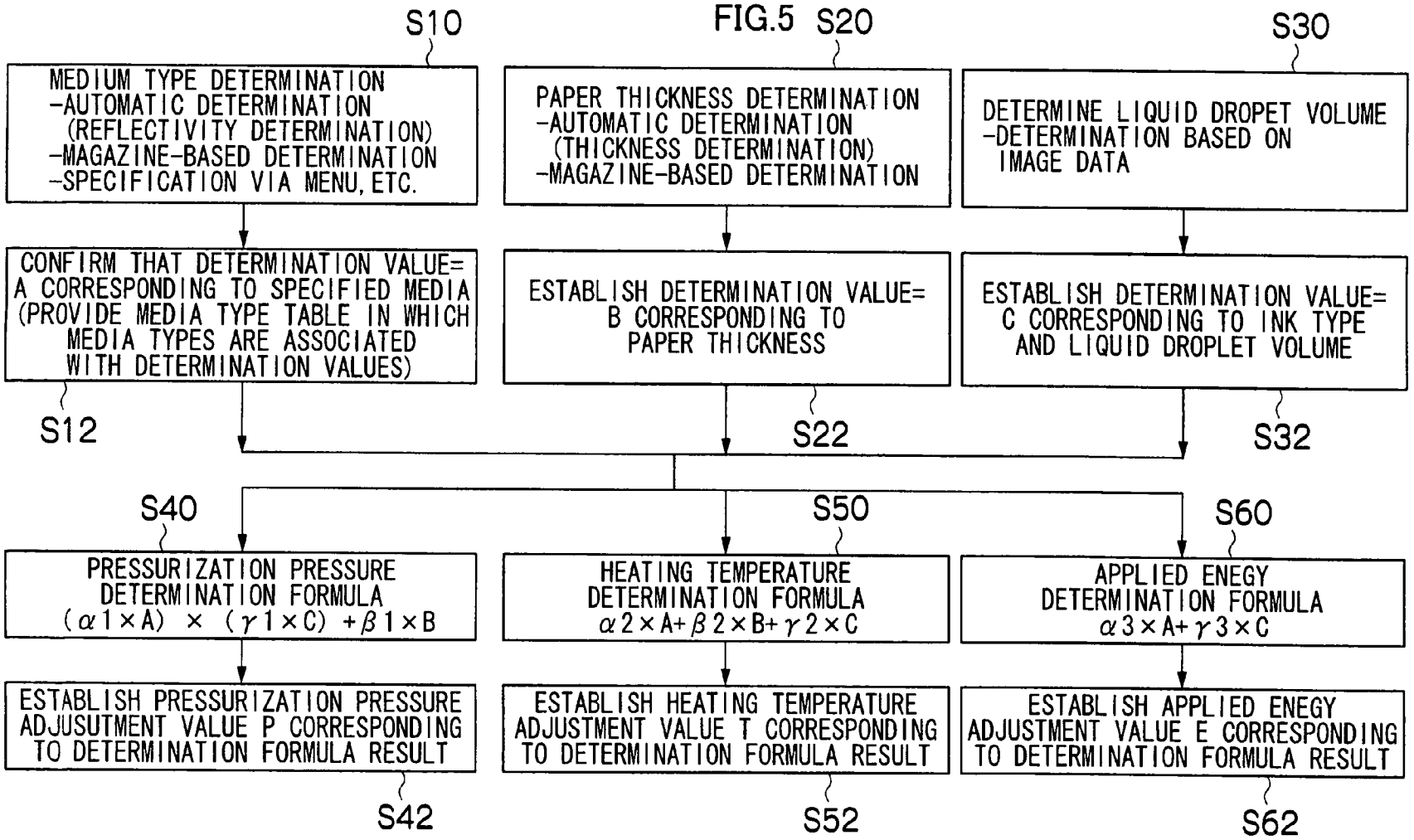
FIG. 5 is a flowchart showing an example of control implemented in an image forming apparatus according to an embodiment.

FIG. 5 is a flowchart showing an example of a control algorithm for the image forming apparatus 10. In this example, the semi-solid solution forming conditions and the pressurization and heating conditions are controlled on the basis of the type of paper (medium), the amount of ink deposited, and the like.

As shown in FIG. 5, firstly, in a media type determination process (step S10), the type of recording medium used is determined. This determination may be based, for example, on automatic determination by measuring the optical reflectivity of the recording paper 20, on determination of the paper magazine, or on specification of a paper type via a user interface menu, or the like.

On the basis of the media type determination result in step S10, the determination value corresponding to the media type used is established as "A" (step S12). The image forming apparatus 10 comprises an information storage device (internal memory or external memory) which stores data for a media type table that associates media types with determination values. The determination value is determined by referring to the media type table.

In parallel with, or subsequently to, the media type determination process described above (step S1), a process for determining the paper thickness is carried out (step S20). The paper thickness is determined by automatic determination based on determining the thickness of the recording paper 20, or by determining the paper magazine, or the like. On the basis of the result of the paper thickness determination in step S20, a determination value corresponding to the paper thickness is established as "B" (step S22).

Furthermore, the ink droplet volume is determined on the basis of the data relating to the image to be printed (step S30), and a determination value corresponding to this ink droplet volume is established as "C", on the basis of the type of ink used and other factors (step S32).

An applied pressure is determined on the basis of the determination values A, B and C determined in this way. For example, when a suitable value for the applied pressure is determined, a prescribed weighting is applied to the droplet volume and the paper thickness. Since the permeation conditions vary depending on the type of media, and the like, and the suitable pressure is calculated according to the following Formula 1 which is a conditional formula of an applied pressure determination formula obtained by performing the multiplication of the coefficients of terms relating to the media type (step S40).

$$(\alpha 1 \times A) \times (\gamma 1 \times C) + \beta 1 \times B \qquad \text{Formula 1}$$

The coefficients $\alpha 1$, $\gamma 1$, and $\beta 1$ are prescribed values.

The result of this applied pressure determination formula, Formula 1, is derived, and a pressurization pressure adjustment value P is established corresponding to this result (step S42).

As stated previously, the applied pressure is controlled during pressurization and fixing by, for example, adopting a composition in which the pressure is applied by means of spring loading of a nip roller 45. According to this composition, the pressure can be adjusted by extension or contraction of a spring in accordance with the pressurization pressure adjustment value P determined at step S42. In this way, it is possible to prevent peeling and cracking of the ink by avoiding large variations in the pressurization conditions applied to the ink (namely, by controlling the variation in pressurization conditions to a prescribed range).

Moreover, the heating temperature is determined on the basis of the determination values A, B and C derived in steps S12, S22 and S32. For example, in order to set a suitable heating temperature, weightings can be given to the media type, the paper thickness and the droplet volume. In this case, since these factors are generally independent of each other, the temperature is calculated on the basis of the following Formula 2 which is the heating temperature determination formula (step S50).

$$\beta 2 \times A + \beta 2 \times B + \gamma 2 \times C \qquad \text{Formula 2}$$

The coefficients $\alpha 2$, $\gamma 2$, and $\beta 2$ are prescribed values.

The result of this heating temperature determination formula, Formula 2, is derived, and a heating temperature adjustment value T is established corresponding to this result (step S52).

As stated above, the heating temperature can be controlled during pressurizing and fixing by adopting a composition in which a heater 46, such as a halogen lamp, is provided in the central portion of the pressurizing and fixing roller 45, and the temperature of the heater 46 is adjustable in accordance with the heating temperature adjustment value T determined in step S52.

Moreover, the applied energy is determined on the basis of the determination values A, B and C derived in steps S12, S22 and S32. For example, since the thickness of the paper has virtually no effect on this value and certain weightings relating to the media type and the droplet volume which are generally independent of each other, and a suitable value for the applied energy can be calculated according to an applied energy determination formula such as the following Formula 3 (step S60).

$$\alpha 3 \times A + \gamma 3 \times C \qquad \text{Formula 3}$$

The coefficients $\alpha 3$ and $\gamma 3$ are prescribed values.

The result of the applied energy determination formula, Formula 3, is derived, and an applied energy adjustment value E is established corresponding to this result (step S62).

The irradiation intensity by the semi-solid solution forming light sources 16 can be adjusted in accordance with this applied energy adjustment value E.

In this way, by setting the pressurization and heating conditions of the pressurizing and fixing unit 17 and the irradiation energy conditions of the semi-solid solution forming light sources 16 to optimal conditions, on the basis of information indicating the characteristics of the media and the amount of ink deposited, it becomes possible to achieve a stable fixing process, and hence peeling or cracking of the ink can be prevented.

The foregoing description is related to examples where ultraviolet-curable ink is used; however, in implementing the present invention, the ink is not limited to an ink that is cured by light. Inks cured by irradiation of electron beams, X rays, or other types of radiation, inks cured by heating, or inks by the application of other types of energy, may also be used. In such cases, a semi-solid solution curing unit and a main curing unit which are suitable for activating the hardening agent (for activating polymerization), are provided in accordance with the type of ink used.

The present embodiment is described with respect to a composition in which a plurality of full line heads are arranged respectively for different colors; however, in implementing the present invention, it is also possible to adopt a head composition in which nozzle rows are formed respectively for different colors within an integrated multi-color head. Furthermore, it is also possible to use a shuttle scanning type of head in which a short head is moved back and forth reciprocally, instead of the full line head.

Next, a second embodiment of the present invention is described below.

Figure 6:
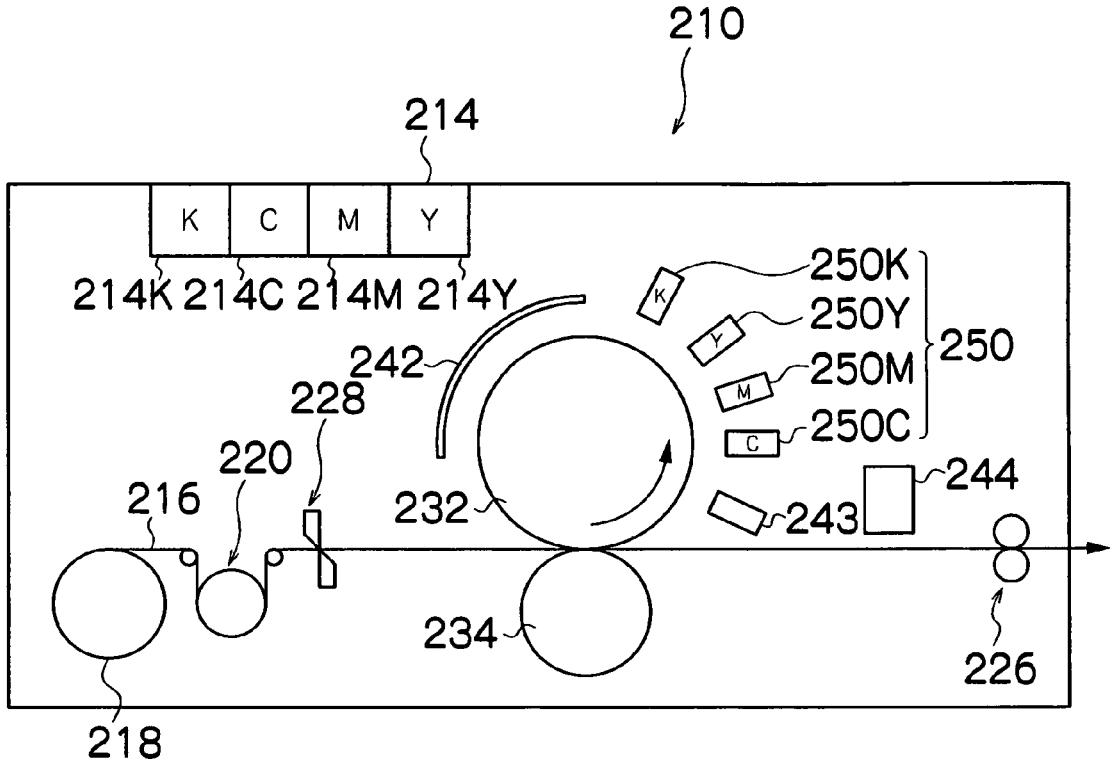
FIG. 6 is a general composition drawing showing a schematic view of an inkjet recording apparatus forming an image forming apparatus relating to a second embodiment of the present invention.

FIG. 6 is a general compositional diagram showing an approximate view of an inkjet recording apparatus forming an image forming apparatus relating to a second embodiment of the present invention.

As shown in FIG. 6, the inkjet recording apparatus 210 according to the present embodiment mainly comprises: a plurality of print heads (liquid droplet ejection heads) 250 (250C, 250M, 250Y, 250K) which eject ink in the form of a liquid droplet; ink storing and loading units 214 (214C, 214M, 214Y 214K) which store inks to be supplied to the print heads 250 (250C, 250M, 250Y, 250K); an intermediate transfer drum (intermediate transfer rotating medium) 232 on the surface of which a transfer image is formed; a paper supply unit 218 which supplies recording paper 216 onto which the transfer image is transferred from the intermediate transfer drum 232, thereby recording an image thereon; and a paper output unit 226 which outputs the recorded recording paper 216.

As shown in FIG. 6, the print heads 250 (250C, 250M, 250Y, 250K) corresponding to the inks of the respective colors are disposed in the sequence, cyan (C), magenta (M), yellow (Y) and black (K), from the upstream side, following the direction of rotation of the intermediate transfer drum 232 (the direction indicated by the arrow shown in FIG. 6).

By ejecting color inks from the print heads 250 (250C, 250M, 250Y, 250K) respectively while the intermediate transfer drum 232 is rotated, a transfer image is formed on the surface of the intermediate transfer drum 232.

In FIG. 6, each of the print heads 250 (250C, 250M, 250Y, 250K) of the respective color inks is filled with a liquid (hereinafter, also simply called "ink") which contains ultraviolet curing initiators (a first ultraviolet curing initiator and a second ultraviolet curing initiator), a polymerizable compound, and a coloring material (dye or pigment).

Figure 7:
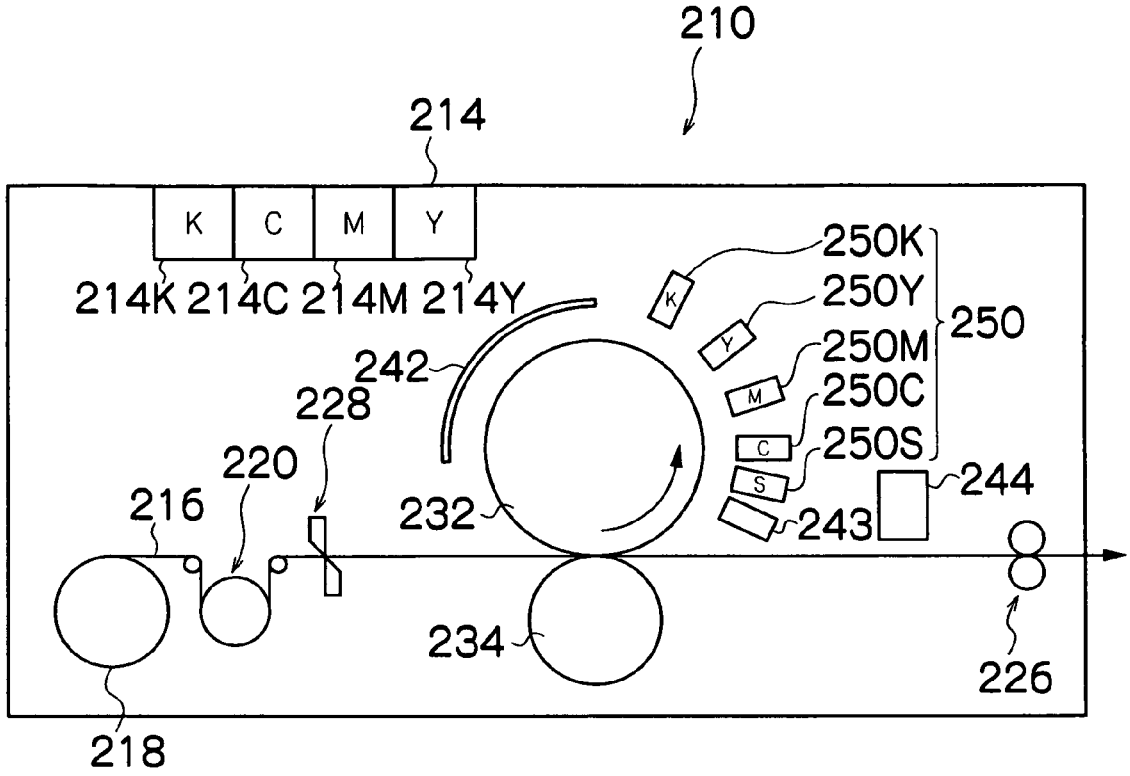
FIG. 7 is a general schematic drawing of a further embodiment of an inkjet recording apparatus forming an image forming apparatus according to an embodiment.

Furthermore, FIG. 7 shows a further example of an inkjet recording apparatus according to the present embodiment.

In the example shown in FIG. 7, a treatment liquid head 250S is disposed on the upstream side in terms of the direction of rotation of the intermediate transfer drum 232, and it is filled with a treatment liquid that contains ultraviolet curing initiators (a first ultraviolet curing initiator and a second ultraviolet curing initiator). Moreover, each of the print heads 250 (250C, 250M, 250Y, 250K) of the respective colors which are arranged on the downstream side, is filled with a liquid containing a polymerizable compound and a coloring material (dye or pigment). By filling the ultraviolet curing initiators and the polymerizable compound separately into the different ejection heads in this way, it is possible to prevent the occurrence of nozzle blockages due to the curing of ink inside the nozzles of a head as a result of scattered ultraviolet light radiated from the semi-curing light source 242 entering inside the nozzles. It is also possible to arrange a treatment liquid head 250S on the upstream side of each of the print heads 250 (250C, 250M, 250Y, 250K) of the respective colors (i.e., before each of the print heads 250).

Furthermore, with respect to the mode shown in FIG. 7; a treatment liquid head 250S filled with a treatment liquid containing a polymerizable compound may be disposed on the upstream side of the intermediate transfer drum 232 (before the intermediate transfer drum 232) in terms of the direction of rotation, and print heads 250 (250C, 250M, 250Y, 250K) of the respective colors, each of which is filled with a liquid containing (first and second) ultraviolet curing initiators and a coloring material (dye or pigment), may be disposed on the downstream side of the treatment liquid 250A (after the treatment liquid 250A). In this case also, since the ultraviolet curing initiators and the polymerizable compound are filled separately into the different ejection heads, it is possible to prevent the occurrence of nozzle blockages due to the curing of ink inside the nozzles of a head as a result of scattered ultraviolet light radiated from the semi-curing light source 242 entering inside the nozzles.

Furthermore, as shown in FIG. 6 or FIG. 7, a semi-curing light source (semi-curing device) 242 is disposed on the downstream side of the print heads 250 in terms of the rotational direction of the intermediate transfer drum 232. Although described in detail below, due to the spectral absorption sensitivity characteristics of the initiators, which are described hereinafter, the semi-curing light source 242 does not cure the liquid ink dots formed on the intermediate transfer drum 232 completely, even if the ink dots receive irradiation by the semi-curing light source 242 a plurality of times as the intermediate transfer drum 232 is rotated. Rather, the light source 242 semi-cures them in such a manner that they become liquid droplets of high viscosity of a level whereby the occurrence of landing interference (e.g., the unification or combination of the liquid droplets of dots formed adjacently in an overlapping fashion on the surface of the recording medium) is prevented.

A cleaner 243 is disposed on the upstream side of the print heads 250 (before the print heads) in terms of the direction of rotation of the intermediate transfer drum 232, in order to clean away the soiling on the surface of the intermediate transfer drum 232 after transfer of a transfer image to the recording paper 216. The cleaner 243 includes: an absorbent roller having water absorbing properties and containing a cleaning solution, which cleans the surface of the intermediate transfer drum 232 while wetting the drum; and an absorbing and removing roller which absorbs and removes water droplets and foreign matter such as dirt, from the surface of the intermediate transfer drum 232, and the like.

As shown in FIG. 6 (or FIG. 7), a magazine for rolled paper (a container in which rolled paper is loaded) may be used as an example of the paper supply unit 218; however, in addition to this, a plurality of magazines with papers of different paper width and quality may be jointly provided. Moreover, paper may also be supplied in cassettes which contain cut papers loaded in layers and which are used jointly or in lieu of magazines for rolled papers.

In the present embodiment, since a transfer image is formed firstly on the intermediate transfer drum 232, and then transferred onto the recording paper 216, it is possible to use various types of recording paper 216, thus increasing the freedom of choice of the recording paper 216 to be used. Moreover, a very fine liquid-repelling section is provided on the intermediate transfer drum 232. Since the non-liquid-repelling section is permeable with respect to the ink solvent, then the absorption of liquid from the inner side of the intermediate transfer drum 232 reduces the occurrence of bleeding or stickiness on the recording medium.

The recording paper 216 delivered from the paper supply unit 218 retains curl due to having been loaded in the magazine in the form of rolled paper. In order to remove this curl, a decurling unit 220 is provided on the downstream side of the paper supply unit 218 (after the paper supply unit 218). The decurling unit 220 applies heat to the recording paper 216, by means of a heating drum, in the direction opposite to the direction of curl induced in the magazine. In this case, the heating temperature is preferably controlled in such a manner that the medium has a curl in which the surface on which the print is to be made is slightly rounded in the outward direction.

In a case in which roll paper is used, a cutter 228 is provided on the downstream side of the decurling unit 220 as shown in FIG. 6 (or FIG. 7), and the roll paper is cut to a desired size by the cutter 228. The cut recording paper 216 is conveyed with the print surface facing upwards in the diagram, and the transfer image formed on the intermediate transfer drum 232 is transferred at the transfer position on the conveyance roller 234. When cut paper is used, the cutter 228 is not required.

It is desirable in terms of high-speed printing, if line heads having a length corresponding to the maximum possible image formation width in the axial direction of the intermediate transfer drum 232 are used as the print heads 250 (250C, 250M, 250Y, 250K), each head being arranged in line with the axial direction of the intermediate transfer drum 232 with the lengthwise direction of the head following a direction substantially perpendicular to the direction of rotation of the intermediate transfer drum 232 (a direction substantially parallel to the axial direction of the intermediate transfer drum 232). Furthermore, the actuators which eject ink may be piezoelectric elements (piezo elements), heat generating bodies, or both. If piezo actuators are used, then in order to arrange the nozzles at high density on the ink ejection surface (nozzle surface), desirably, the nozzles are arranged in an interpolating fashion in a two-dimensional matrix configuration. Furthermore, desirably, the nozzle surface of the print head 250 has a curved shape which follows the circumference of the intermediate transfer drum 232 in the breadthways direction.

Furthermore, although a configuration with the four standard colors, C, M, Y and K, is described in the example shown in FIG. 6 (or FIG. 7), the combinations of the ink colors and the number of colors are not limited to these, and light and/or dark inks can be added as required. For example, a configuration is also possible in which print heads for ejecting light-colored inks such as light cyan and light magenta are added. By adopting this composition, it is possible further to increase the tonal gradations.

The recording paper 216 to which the transfer image formed on the surface of the intermediate transfer drum 232 has been transferred is conveyed further toward the downstream side. A main curing light source (main curing device) 244 for performing main curing which completely fixes the image transferred to the recording medium 216, is disposed on the downstream side of the intermediate transfer drum 232 (after the intermediate transfer drum 232).

Next, the semi-curing light source 242, the main curing light source 244 and the inks used in same are described in detail.

The ink used in the present embodiment is an ultraviolet-curable ink, and in particular, it has two materials forming curing initiators (ultraviolet curing initiators) which have different spectral sensitivity characteristics in the ultraviolet wavelength range. Furthermore, the semi-curing light source 242 and the main curing light source 244 radiates ultraviolet lights having different wavelength ranges, and the two types of curing initiators contained in the ink (ultraviolet-curable ink) include a first curing initiator having a spectral absorption sensitivity at the ultraviolet wavelength of the semi-curing light source 242, and a second curing initiator having a spectral absorption sensitivity at the UV wavelength of the main curing light source 244.

In this way, according to the present embodiment, an ultraviolet-curable ink having two curing initiators having spectral absorption sensitivity at different ultraviolet wavelengths (namely, a first curing initiator which is cured by the semi-curing light source 242, and a second curing initiator which is cured by the main curing light source 244) is used, the liquid ink dots formed by droplets ejected onto the intermediate transfer drum 232 are semi-cured by the semi-curing light source 242 operating at the first wavelength and transferred from the intermediate transfer drum 232 to the recording paper 216, and then main curing of the ink dots is performed by the main curing light source 244 operating at the second wavelength. In this way, high-quality recording can be performed onto various types of recording media.

Moreover, the first curing initiator and the second curing initiator have spectral absorption sensitivity in different wavelengths, and a curing reaction of the second initiator due to the semi-curing light source 242 does not occur. Consequently, rather than performing main curing of the transfer image formed on the intermediate transfer drum 232 while it is on the intermediate transfer drum 232, the image is transferred in a state where it has been cured to a level whereby the occurrence of landing interference on the intermediate transfer drum 232 is prevented, and hence the transferability of the transfer image to the recording medium is guaranteed.

Figure 8:
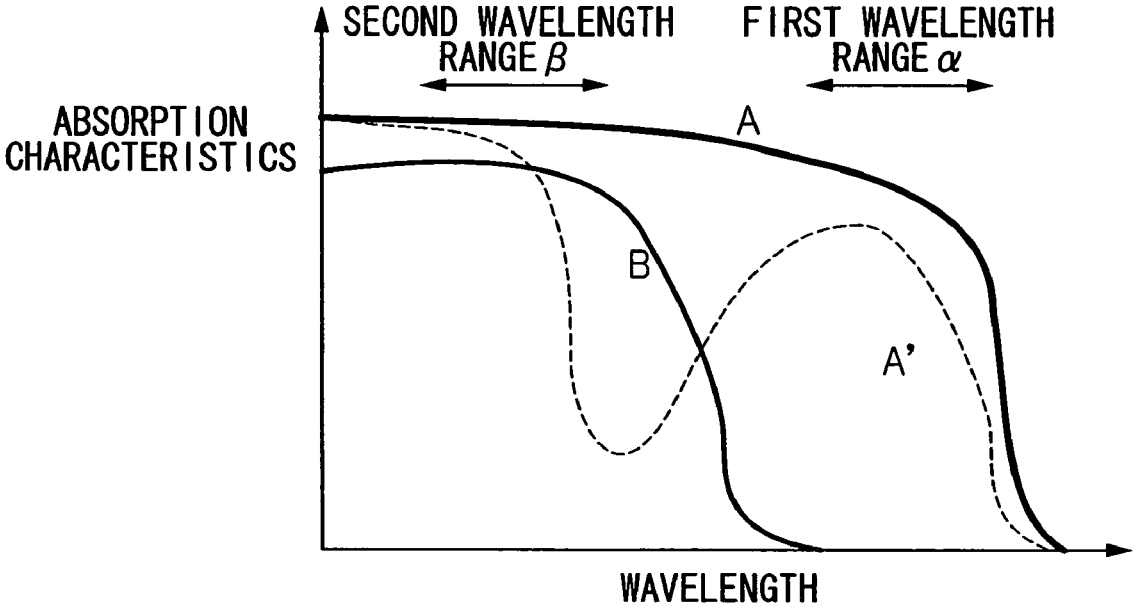
FIG. 8 is a graph showing absorption characteristics of curing initiators.

FIG. 8 shows one example of the relationship between the wavelengths and the spectral absorption characteristics of the materials of the first curing initiator for semi-curing, and the second curing initiator for main curing.

For the first curing initiator for semi-curing, a material is selected which has the absorption characteristics indicated by A or A' shown in FIG. 8, and during semi-curing, the irradiation wavelength of the ultraviolet light radiated from the semi-curing light source 242 contains at least a wavelength which is in the first wavelength range a shown in FIG. 8 and which is on a longer wavelength side from the second wavelength range. It is a required condition that the first curing initiator has absorption characteristics at least in the first wavelength range, but it does not necessarily need to have absorption characteristics in the second wavelength range. However, in general, the large number of compounds have absorption characteristics in the second wavelength range as well.

Furthermore, for the second curing initiator for main curing, a material is selected which has spectral absorption characteristics at least in a second wavelength range being on a shorter wavelength side from the first wavelength range and has no spectral absorption characteristics in the first wavelength range, as indicated by B in FIG. 8. During main curing, the irradiation wavelengths of the ultraviolet light radiated by the main curing light source 244 includes a wavelength at least in the second wavelength range β shown in FIG. 8. However, no problem arises, even if the first wavelength range is included in the irradiation wavelengths from the main curing light source 244.

Here, as shown in FIG. 8, the lower limit of the irradiation region α is required to be set to a wavelength equal to or greater than the wavelength where the amount of absorption in the absorption characteristics B becomes substantially zero.

In this way, desirably, the first curing initiator for semi-curing has spectral absorption characteristics at least in the first wavelength range α, and the second curing initiator for main curing has spectral absorption characteristics at least in the second wavelength range β, which is on a shorter wavelength side from the first wavelength range, and has no spectral absorption characteristics in the first wavelength range α.

In the present embodiment, for the first curing initiator, for example, a curing initiator having peak spectral sensitivity characteristics in the wavelength range of 350 to 400 nm is used in the semi-curing step, whereas a curing initiator having peak spectral sensitivity characteristics in the wavelength range of 230 to 280 nm is used in the main curing step.

In this way, by selecting, for the main curing step, a curing initiator having spectral sensitivity in a wavelength range which is lower than that used in the semi-curing step, the ultraviolet light is able to penetrate reliably into the interior of the ink and hence main curing can be carried out reliably.

Furthermore, in this case, the combination ratio of the first curing initiator, the second curing initiator and the polymerizable compound is a combination ratio whereby, even if the first curing initiator reacts and creates a polymerization reaction with the polymerizable compound upon receiving a large amount of radiated ultraviolet light (having a wavelength within a range of 350 to 400 nm or within a range of 350 nm or above) a plurality of times, from the semi-curing light source 242, the liquid ink dots formed on the intermediate transfer drum 232 do not cure completely, but rather become highly viscous liquid droplets which impede the occurrence of landing interference, and the liquid droplets can be maintained in this semi-cured state which allows the liquid ink dots formed on the intermediate transfer drum 232 to be transferred.

Furthermore, the combination ratio between the first curing initiator, the second curing initiator and the polymerizable compound is set in such a manner that, when the second curing initiator reacts and creates a polymerization reaction with the polymerizable compound, upon receiving irradiation of ultraviolet light (having a wavelength within a range of 230 to 280 nm or within a range including this wavelength range) from the main curing light source 244, then the liquid ink dots transferred to the recording paper 216 are cured completely.

Figure 10:
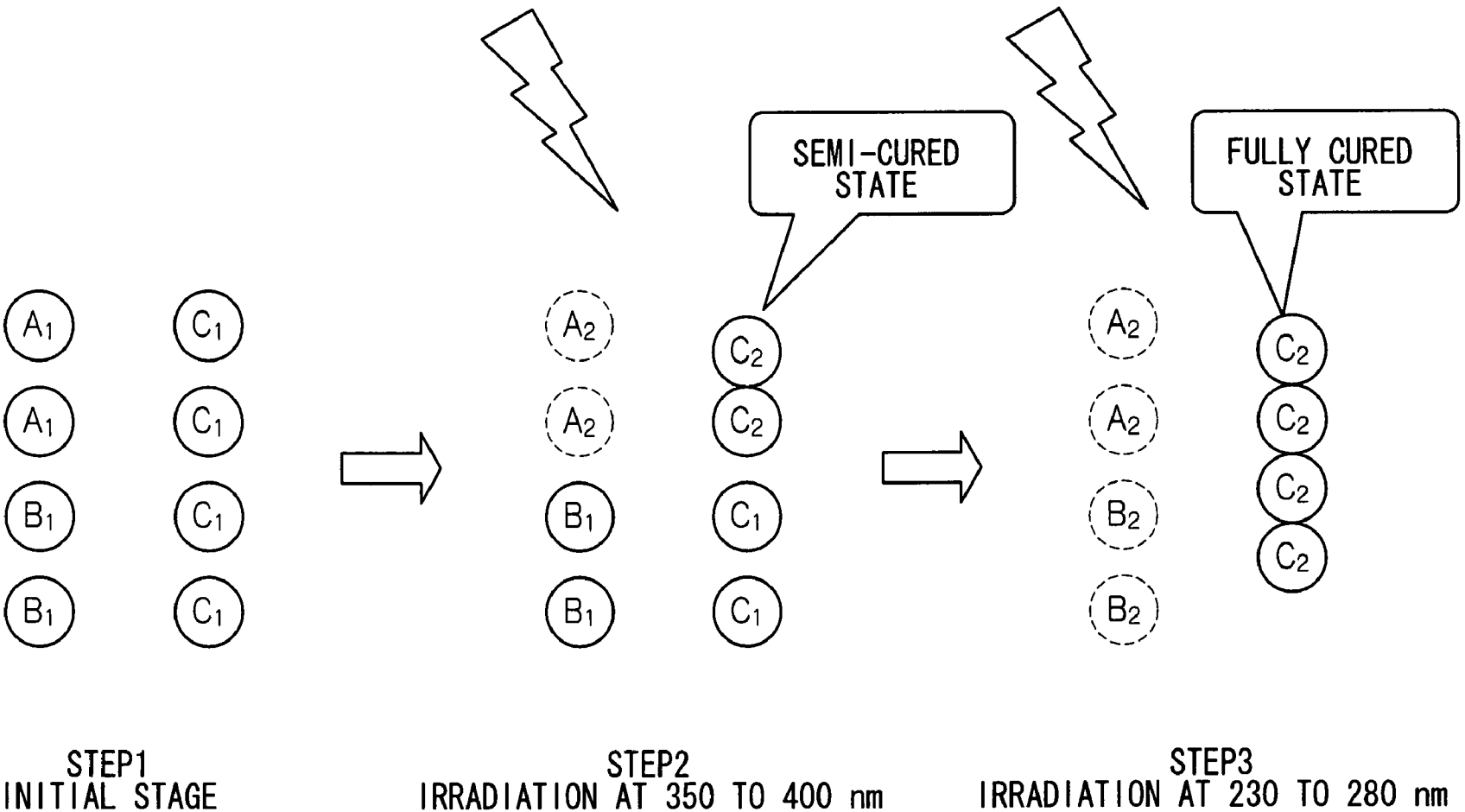
FIG. 10 is an illustrative diagram of a polymerization reaction by means of a curing initiator.

FIGS. 9 and 10 show conceptual views of these conditions, which are described below.

FIG. 9 describes the symbols used in FIG. 10. In FIG. 9, A1 indicates a state before ultraviolet light has been radiated onto the first curing initiator, and before radicals have been released. Furthermore, A2 represents a state after the first curing initiator has received irradiation of ultraviolet light, and the radicals have been released. Moreover, similarly, B1 shows a state before the second curing initiator has received irradiation of ultraviolet light and before radicals have been released, and B2 shows a state after the second curing initiator has received irradiation of ultraviolet light and the radicals have been released. Furthermore, C1 indicates a monomer state before polymerization of the polymerizable compound, and C2 indicates a polymer state after polymerization of the polymerizable compound.

In FIG. 10, the state in step 1 shows an initial state, and both the first and the second curing initiators are in the initial states A1 and B1 before irradiation of ultraviolet light, where the radicals have not been released. Furthermore, the polymerizable compound C is not polymerized at all, and all of the compound is in a monomer state C1.

Here, when the irradiation of ultraviolet light within a range of 350 to 400 nm from the semi-curing light source 242 is performed, then only the first curing initiator A1 reacts, and the state of the first curing initiator changes to state A2, where the radicals have been released. When the first curing initiator changes from state A1 to state A2, the radicals act upon the polymerizable compound C1, and the polymerizable compound changes from state C1 to state C2, in an amount corresponding to the amount of the first curing initiator that has changed from state A1 to state A2.

Even if the irradiation of ultraviolet light from the semi-curing light source 242 is further performed in this state, then the second curing initiator does not react but remains in state B1, and half of the polymerizable compound remains as a monomer in state C1. Consequently, the semi-cured state is maintained, and the state which prevents landing interference is maintained, a state which allows smoothing in the first embodiment is maintained, and a state which allows the transfer in the second embodiment is maintained.

When the mixed liquid droplets combining initiator and polymerizable compound that have been ejected onto the recording paper 20 in FIG. 1 have been supplied to the pressurization and fixing unit 17 (smoothing device) and have undergone a smoothing process in the state shown in step 2 in FIG. 10. After that, the mixed liquid droplets undergo the irradiation of ultraviolet light from the main curing light source 18. Since the wavelength range is different from that used during semi-curing, then the radicals are released from the second curing initiator B1, a polymerization reaction of the monomer C1 of the remaining polymerizable compound occurs, thereby creating the polymer state C2. Hence, main curing as shown by the state in step 3 in FIG. 10 is achieved.

In the case of the composition of the ultraviolet-curable ink described above, droplets of an initiator are ejected onto the recording paper 20 by the print head 12CL shown in FIG. 1, whereupon, droplets containing K ink and a polymerizable compound are ejected by the head 12K, thereby forming mixed liquid droplets on the recording paper 20. Ultraviolet light (wavelength 350 to 400 nm) is radiated by the semi-solid solution forming light source 16A onto the mixed liquid droplets of the K ink, whereby the first curing initiator causes a polymerization reaction of the polymerizable compound and the K ink becomes a semi-cured state, which prevents the occurrence of landing interference (the state in step 2 in FIG. 10).

When droplets of M ink, C ink and Y ink are subsequently ejected onto the recording medium and ultraviolet light (wavelength 350 to 400 nm) is radiated respectively onto same by the semi-curing light sources 16B to 16D, then the K ink will have received irradiation of ultraviolet light from the semi-curing light source 242 four times.

However, since all of the first curing initiator contained in the K ink is consumed when the K ink is semi-cured by the first irradiation of ultraviolet light by the semi-curing light source after ejecting droplets of K ink, a further curing reaction of the K ink due to the second and subsequent irradiations of ultraviolet light by the semi-curing light sources 16 does not progress, and hence it is possible to maintain a semi-solid solution state whereby landing interference is prevented and leveling is enabled (the state in step 2 in FIG. 10).

Moreover, if droplets of M ink are ejected so as to overlap with the dots of C ink, then since the dots of C ink are already semi-cured and in a semi-solid solution state, then there is no occurrence of main curing of the C ink dots due to the first curing initiator in the dots of M ink creating a polymerization reaction with the unreacted polymerizable compound in the C ink.

Thereupon, the mixed liquid droplets which have been ejected onto the recording paper 20 and have reached a semi-cured state are subjected to a leveling process by the pressurization and fixing unit 17, irradiated with ultraviolet light by the main curing light source 18, and thus main curing is performed as shown in step 3 in FIG. 10.

To repeat the description with respect to FIG. 8, in the step of semi-curing in the aforementioned wavelength range a shown in FIG. 8, since the second curing initiator has absorption characteristics B as shown in FIG. 8, then the amount of absorption is substantially zero with respect to the wavelength range $\alpha$, and hence the second curing initiator does not release the radicals. On the other hand, in the step of main curing in the wavelength range $\beta$, the second curing initiator releases the radicals, thus performing main curing. In this case, if there is remaining unreacted material of the first curing initiator, then radicals are released from the first curing initiator also; however, since this step is a main curing step, then this does not create a problem, but rather it is desirable because it promotes a complete curing reaction.

Next, an example of the second embodiment is described below. For the main curing light source 242, a metal halide lamp, or the like, may be used for irradiation of ultraviolet light in the wavelength range of 350 to 400 nm as described above. A semi-curing light source 242 which radiates ultraviolet light in a wavelength range of 350 to 400 nm is disposed with an arc-shaped irradiation surface following the external circumference of the intermediate transfer drum 232, on the downstream side of the print heads 250C, 250M, 250Y and 250K of C, M, Y and K, in terms of the direction of rotation of the drum. Furthermore, although described in detail below, the irradiation intensity and the arc length of the ultraviolet light irradiation light source are set to prescribed values in order to enable high-speed recording by shortening the time period required for semi-curing, namely, "the semi-curing time Thc".

The semi-curing light source 242 has a length equal to or exceeding the width of the intermediate transfer drum 232, similarly to the print heads 250 (250C, 250M, 250Y, 250K).

Moreover, the main curing light source 244 is similarly constituted by a metal halide lamp, or the like, which radiates ultraviolet light in the wavelength range of 230 to 280 nm onto the recording medium onto which the image has been transferred.

The main curing light source 244 is disposed at a position opposing the recording medium on the downstream side of the intermediate transfer unit. Similarly to the semi-curing light source 242, the main curing light source 244 has a length equal to or exceeding the width of the recording medium. Since this light source is designed to perform final main curing, then by setting a wavelength range that is relatively shorter (lower) than the semi-curing light source 242, the ultraviolet light penetrates more readily into the interior of the dots, and hence a main curing reaction can be achieved reliably.

Here, the first spectral sensitivity at which semi-curing is performed corresponds to 350 to 400 nm, and the second spectral sensitivity at which main curing is performed corresponds to 230 to 280 nm; however, the invention is not limited to these wavelength ranges, and it is also possible to set other suitable wavelength ranges. In this case, desirably, the first spectral sensitivity wavelength range and the second spectral sensitivity wavelength range are separate ranges. Furthermore, in these light sources (semi-curing light source 242 and main curing light source 244), it is possible to use a selectable-wavelength filter with a metal halide lamp.

Moreover, the two types of curing initiator having these spectral sensitivities are not limited in particular, but examples thereof are described below. For instance, for the first curing initiator for semi-curing having a spectral sensitivity of 350 to 400 nm, it is appropriate to use 0.1% of DAROCUR TPO, 2, 4, 6-trimethylbenzoyl-diphenyl-phosphine oxide. The chemical formula of this is given below.

Formula 1

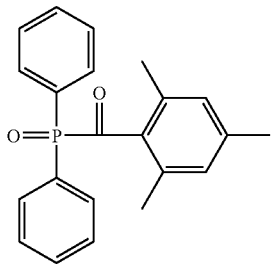

Figure 11:
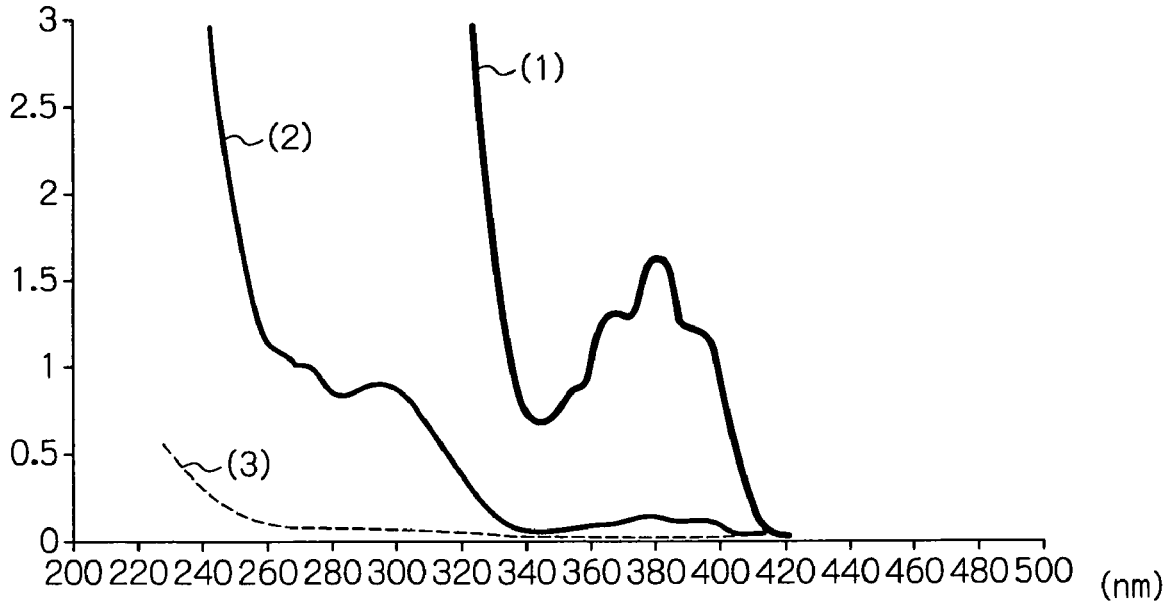
FIG. 11 is a graph showing absorption characteristics of curing initiators for semi-curing.

Furthermore, FIG. 11 shows the absorption characteristics in an acetonitrile solution. In FIG. 11, the concentration in the acetonitrile solution is 0.1% in the graph indicated by (1), 0.01% in the graph indicated by (2), and 0.001% in the graph indicated by (3). As indicated in FIG. 11, if the concentration is 0.1%, then the absorptivity has a peak in the vicinity of the wavelength 380 nm.

Furthermore, for instance, for the second curing initiator for main curing having a spectral sensitivity of 230 to 280 nm, it is appropriate to use 0.01% of IRGACURE651, 2, 2-diemetoxy-1,2-diphenylethane-1-one. The chemical formula of this is given below.

Formula 2

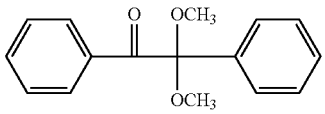

Figure 12:
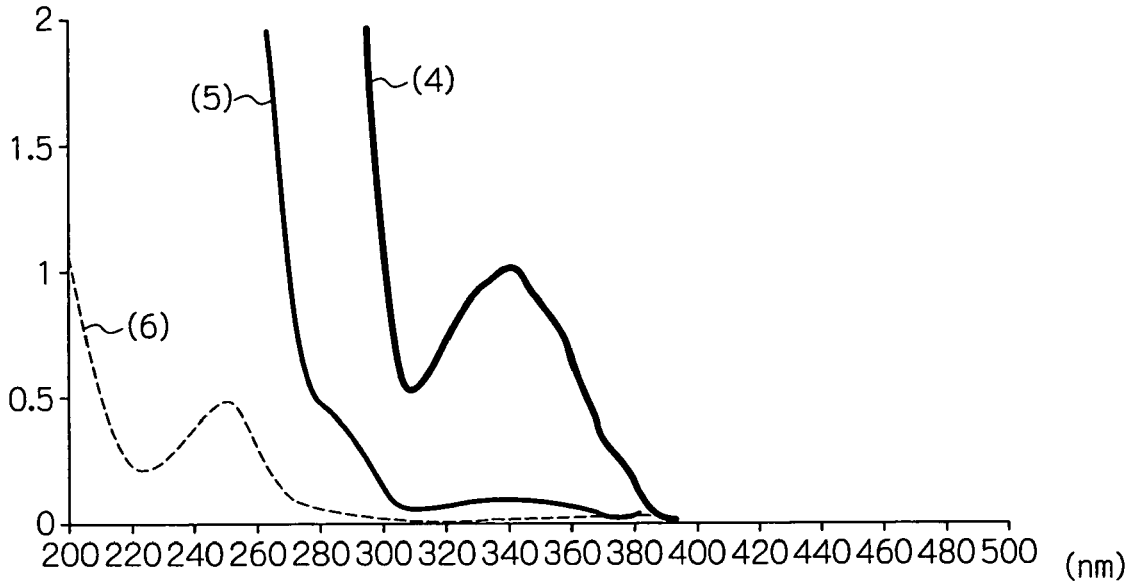
FIG. 12 is a graph showing absorption characteristics of curing initiators for main curing.

Furthermore, FIG. 12 shows the absorption characteristics in an acetonitrile solution. In FIG. 12, the concentration in the acetonitrile solution is 0.1% in the graph indicated by (4), 0.01% in the graph indicated by (5), and 0.001% in the graph indicated by (6). As indicated in FIG. 12, if the concentration is 0.01%, then the absorptivity has a large value in the range of approximately 280 nm and below.

Furthermore, in order to achieve high-quality image formation, it is necessary to prevent landing interference when a transfer image is formed on the intermediate transfer drum 232.

Next, the droplet ejection control performed in order to prevent landing interference between dots of inks of the same color in forming a transfer image onto the intermediate transfer drum 232, is described below.

Firstly, the terms used in the following description is explained.

Here, "landing interference" occurs when droplets are ejected to form overlapping dots on the recording medium, and it refers to the combination or unification of the liquid droplets of the dots on the surface of the recording medium, which gives rise to disruption of the dot shapes, or non-uniform mixing of colors between inks of different colors, thus giving rise to image deterioration.

The "amount (degree) of overlap of the dots" is a physical quantity indicating the amount (degree) by which adjacent dots overlap with each other.

Here, the number of dots which are mutually overlapping (also called the "overlap number") is used as the "amount of overlap of the dots".

Figure 13A:
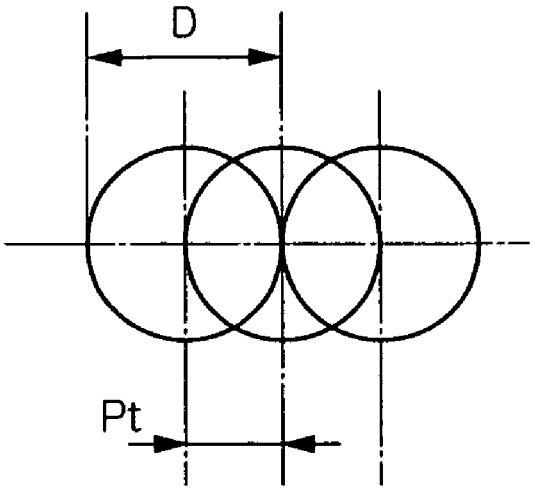
FIG. 13A is an illustrative diagram of a case where the amount of overlap of the dots is "2"

For example, if two dots arranged in the sub-scanning direction (the lateral direction in the drawing) are mutually overlapping, but alternately positioned dots of the dots do not overlap with each other, as shown in FIG. 13A, in other words, if the distance Pt between the centers of the adjacent dots, and the dot diameter D, have the relationship "$D/2 \leqq Pt < D$", then the amount of overlap, Vn, satisfies "$Vn=2$".

Figure 13B:
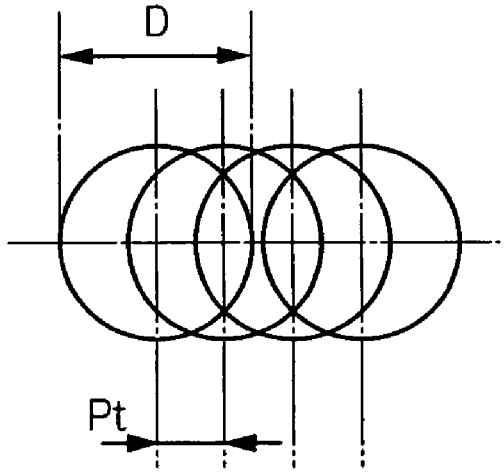
FIG. 13B is an illustrative diagram of a case where the amount of overlap of the dots is "3"

Furthermore, if three dots are mutually overlapping and the dots which are disposed two dots apart are not overlapping with each other, as shown in FIG. 13B, in other words, if "$D/3 \leqq Pt \leqq D/2$" is satisfied, then the amount of overlap, Vn, satisfies "$Vn=3$".

If a plurality of dots of different diameters are used, then the amount of dot overlap obtained when the maximum dot size is used is adopted.

Furthermore, here, "semi-curing" means a state whereby the liquid droplets, rather than being completely cured, become high viscosity liquid droplets which do not allow landing interference to occur. In the present embodiment, since a transfer image is formed on an intermediate transfer drum 232 and then transferred onto a recording paper 216, it is necessary to prevent landing interference between the dots formed by droplets ejected onto the intermediate transfer drum 232 and to guarantee transferability, and therefore desirably, the droplets are made to be in a semi-solid state in which they are not cured completely.

Figure 14:
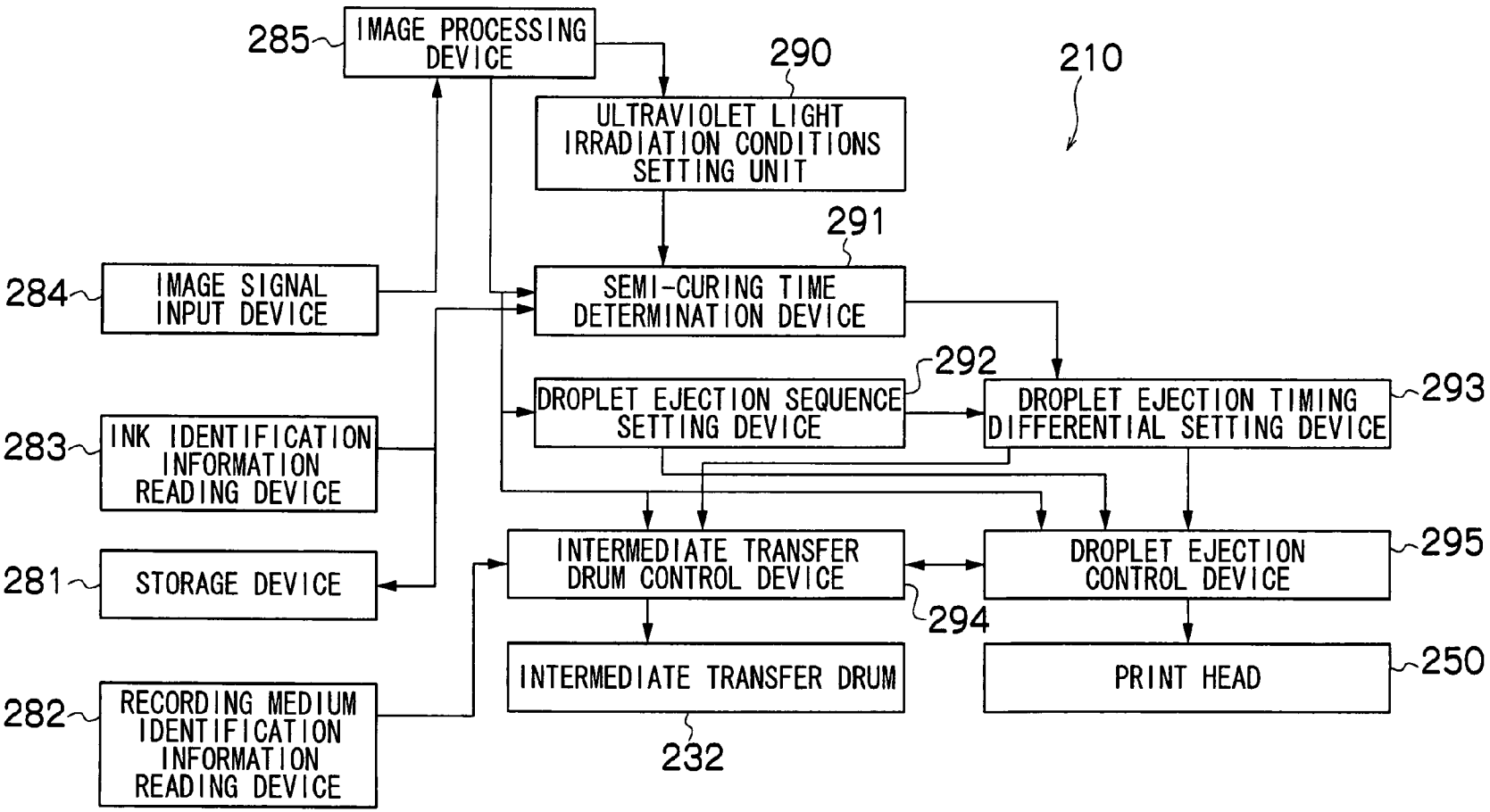
FIG. 14 is a block diagram showing the functional composition of an inkjet recording apparatus according to an embodiment.

FIG. 14 is a block diagram showing the functional composition of an inkjet recording apparatus forming one embodiment of an image forming apparatus according to the present invention.

In FIG. 14, the inkjet recording apparatus 210 principally comprises: an intermediate transfer drum 232, print heads 250, a storage device 281, a recording medium identification information reading device 282, an ink identification information reading device 283, an image signal input device 284, an image processing device 285, an ultraviolet irradiation conditions setting unit 290, a semi-curing time determination device 291, a droplet ejection sequence setting device 292, a droplet ejection timing differential setting device 293, an intermediate transfer drum control device 294, and a droplet ejection control device 295.

The print head 250 has a plurality of nozzles arranged at least in the main scanning direction, and it ejects ink in the form of liquid droplets onto the rotating intermediate transfer drum 232, from nozzles selected from the plurality of nozzles in accordance with an image signal, in such a manner that an image (transfer image) corresponding to the image signal and including a plurality of dots is formed on the intermediate transfer drum 232.

The storage device 281 stores information relating to image formation. For example, table information required in order to specify the semi-curing time of each dot is stored in the storage device 281.

The recording medium identification information reading device 282 reads in identification information (ID) with which type of recording medium can be identified, from a medium accommodating magazine which accommodates recording media.

The ink identification information reading device 283 reads in identification information (ID) with which the ink type can be identified, from an ink cartridge storing ink.

The identification information may be read in by the recording medium identification information reading device 282 and the ink identification information reading device 283, by means of wireless reading from a radio tag (also called RFID), optical reading from a barcode, or the like, magnetic reading, or another type of reading mode.

The image signal input device 284 inputs an image signal from a host computer (not shown). The image signal includes image data which corresponds to the object of image formation, and information indicating the output resolution.

The image processing device 285 carries out various types of image processing on the image data input by the input signal input device 284. The image processing device 285 calculates the amount of dot overlap on the basis of the output resolution (or the dot pitch), and a desired tone density expression, and the like.

Here, the amount of overlap includes: an amount of overlap, Vs, indicating the amount of overlap between dots in the sub-scanning direction (sub-scanning direction dot overlap), an amount of overlap, Vm, indicating the amount of overlap between dots in the main scanning direction (main scanning direction dot overlap), and an amount of overlap, $V\alpha$, indicating the amount of overlap between dots in a direction (oblique direction) which is inclined with respect to the sub-scanning direction (oblique direction dot overlap).

The ultraviolet light irradiation conditions setting unit 290 sets the ultraviolet light irradiation conditions on the basis of the image data from the image processing device 285. Furthermore, the semi-curing time determination device 291 specifies the semi-curing time for each dot (dot unit) on the intermediate transfer drum 232, on the basis of the table information stored in the storage device 281.

More specifically, it determines the semi-curing time for the dots corresponding to the parameters, namely, the ink identification information read in by the ink identification information reading device 283, the ultraviolet light irradiation conditions, the dot diameter, and the like.

The droplet ejection sequence setting device 292 sets the droplet ejection sequence of the dots in the sub-scanning direction and the main scanning direction.

In particular, this droplet ejection sequence setting device 292 sets the droplet ejection sequence of the dots in such a manner that, when droplets are ejected to form adjacent dots which overlap with each other in both the sub-scanning direction and the main scanning direction, the shapes of the dots which overlap with the adjacent dots are not deformed, in the sub-scanning direction, the main scanning direction and the oblique direction.

There are various modes for setting such a droplet ejection sequence.

A first droplet ejection sequence setting mode is a mode in which the amount of dot overlap in the oblique direction, $V\alpha$, is specifically considered, and the droplet ejection sequence of the dots in the sub-scanning direction and the main scanning direction is set on the basis of the value of $V\alpha$.

Here, for the amount of overlap of the dots in the oblique direction, $V\alpha$, the number of dots formed by droplets ejected so as to overlap with a particular dot (dot under consideration) (namely, the overlap number of the dots in the oblique direction) is used.

Here, the amount of overlap between dots in the oblique direction, $V\alpha$, is described in more detail. Taking a plurality of dots aligned in the sub-scanning direction to be a row, and a plurality of dots aligned in the main scanning direction to be a column, here, a dot in the ith row (sub-scanning direction row) and the jth column (main scanning direction column) is considered. In the (i+1)th sub-scanning row, in other words, in a row adjacent to the sub-scanning row to which the dot under consideration belongs, the main scanning column of the dot(s) which overlap with the dot under consideration (row i, column j) are investigated. Here, in the (i+1)th row, the investigation is performed from a dot of the jth column, and if dots up to the $(j+V\alpha-1)$th column overlap with the dot under consideration, whereas the dot in the $(j+V\alpha)$th column does not overlap with the dot under consideration, then this value of $V\alpha$ is taken to be the amount of overlap of the dot in the oblique direction. Here, the words "row" and "column" are defined conveniently in order to describe the amount of overlap of the dots in the oblique direction, $V\alpha$, and normally, a plurality of dots aligned in the sub-scanning direction is called a dot column.

If the amount of overlap of the dots in the oblique direction is $V\alpha$, and the amount of overlap of the dots in the main scanning direction is Vm, then when a solid image is formed on the intermediate transfer drum 232, a dot column is divided in terms of the sub-scanning direction, by taking $V\alpha \times Vm$ as the basic unit M, in such a manner that droplets are ejected at intervals of $(V\alpha \times Vm-1)$ dots apart in the sub-scanning direction, and a phase difference equivalent to $V\alpha$ dots is set between dots which are mutually adjacent in the main scanning direction, in such a manner that droplets are ejected at intervals of $(Vm-1)$ dots apart in the main scanning direction.

In this way, the dot arrangement comprising a plurality of dots arranged two-dimensionally in the sub-scanning direction and the main scanning direction is divided up into N groups, on the basis of the basic unit M, which is $V\alpha \times Vm$. Grouping of this kind is called N×M grouping. For example, in FIG. 17, a string of dots from a circled 1 to a circled 9, arranged consecutively in the sub-scanning direction, is defined as a "group".

In the sub-scanning direction, M $(=V\alpha \times Vm)$ dots in a consecutive alignment belong to one group.

Furthermore, with respect to the sub-scanning direction, dots in each of the groups, which are from the first group to the Nth group, are assigned successively to a first set to an Mth $(=(V\alpha \times Vm)$th) set. When droplets are actually ejected, firstly, droplets forming dots of the first set only are ejected consecutively, from the first group to the Nth group; whereupon droplets forming dots of the second set only are ejected consecutively, from the first group to the Nth group; and finally, droplets forming dots of the Mth set only are ejected consecutively, from the first group to the Nth group. In this case, in the sub-scanning direction, droplets forming dots are ejected at intervals of $(V\alpha \times Vm-1)$ dots apart.

Droplets forming dots ejected consecutively from the nozzles during one rotation of the drum in this way are called to belong to the same set. For example, in FIG. 17, dots indicated by the same dot number in the sub-scanning direction are defined as dots of the same set. In a second mode of setting the droplet ejection sequence, rather than considering the amount of overlap of the dots in the oblique direction, $V\alpha$, the droplet ejection sequence for the dots in the sub-scanning direction and the main scanning direction is set principally on the basis of the amount of overlap between dots in the sub-scanning direction, Vs, and the amount of overlap between dots in the main scanning direction, Vm.

More specifically, the droplet ejection sequence is set in such a manner that, when a solid image is formed on the intermediate transfer drum 232, the dot arrangement comprising a two-dimensional arrangement in the main scanning direction and the sub-scanning direction on the intermediate transfer drum 232 is divided into groups by using a two-dimensional block of $Vs \times Vm$ as the basic unit, where Vs is the number of dots in the sub-scanning direction, and Vm is the number of dots in the main scanning direction. By this means, droplets are ejected at intervals of $(Vs-1)$ dots apart in the sub-scanning direction and droplets are ejected at intervals of $(Vm-1)$ dots apart in the main scanning direction.

Furthermore, it is also possible to set the droplet ejection sequence by referring to parameters other than the amount of overlap, Vs, Vm or $V\alpha$.

For example, the droplet ejection sequence of the dots in the sub-scanning direction and the main scanning direction may be set on the basis of the semi-curing time of each dot, the amount of overlap of the dots in the main scanning direction, and the amount of overlap of the dots in the oblique direction.

The droplet ejection timing differential setting device 293 sets the droplet ejection timing differential between adjacent dots, in such a manner that the droplet ejection timing differential between adjacent dots which overlap with each other is equal to or greater than the semi-curing time per dot as determined by the semi-curing time determination device 291.

Here, the droplet ejection timing differential setting device 293 sets the ejection cycle of the nozzles in accordance with the droplet ejection sequence set by the droplet ejection sequence setting device 292.

The intermediate transfer drum control device 294 changes the setting of the rotational speed of the intermediate transfer drum 232. The intermediate transfer drum control device 294 changes the setting of the rotational speed of the intermediate transfer drum 232 (also called the "number of rotations"), on the basis of the output resolution and the semi-curing time per dot with respect to the nozzles, and the like. In this case, the droplet ejection timing differential setting device 293 sets the nozzle ejection cycle, and it also sets the rotational speed of the intermediate transfer drum 232 in accordance with the settings established for the nozzle ejection cycle and the semi-curing time.

The droplet ejection control device 295 controls droplet ejection from the nozzles of the print head 250, on the basis of the image signal. In the case of droplet ejection of this kind, the droplet ejection control device 295 controls droplet ejection from the nozzles of the print head 250 on the basis of the droplet ejection sequence set by the droplet ejection sequence setting device 292 and the droplet ejection timing differential between the adjacent dots set by the droplet ejection timing differential setting device 293.

Furthermore, the droplet ejection timing differential setting device 293 sets the nozzle ejection cycle of the print head 250, in accordance with the droplet ejection sequence set by the droplet ejection sequence setting device 292, on the basis of the semi-curing time Thc per dot with respect to the nozzles, the pass time Tpass, with respect to the print head 250, of the area of the perimeter of the intermediate transfer drum 232 on which a transfer image is not recorded, and the number of groups, N.

Table information is created and stored in advance in the storage device 281. The table information indicates the semi-curing time for preventing the occurrence of landing interference by a curing reaction of the dots, corresponding to parameters relating to environmental conditions, such as the type of ultraviolet-curable ink, the type of recording medium, the dot diameter, the ultraviolet light irradiation energy, and the like.

Figure 15:
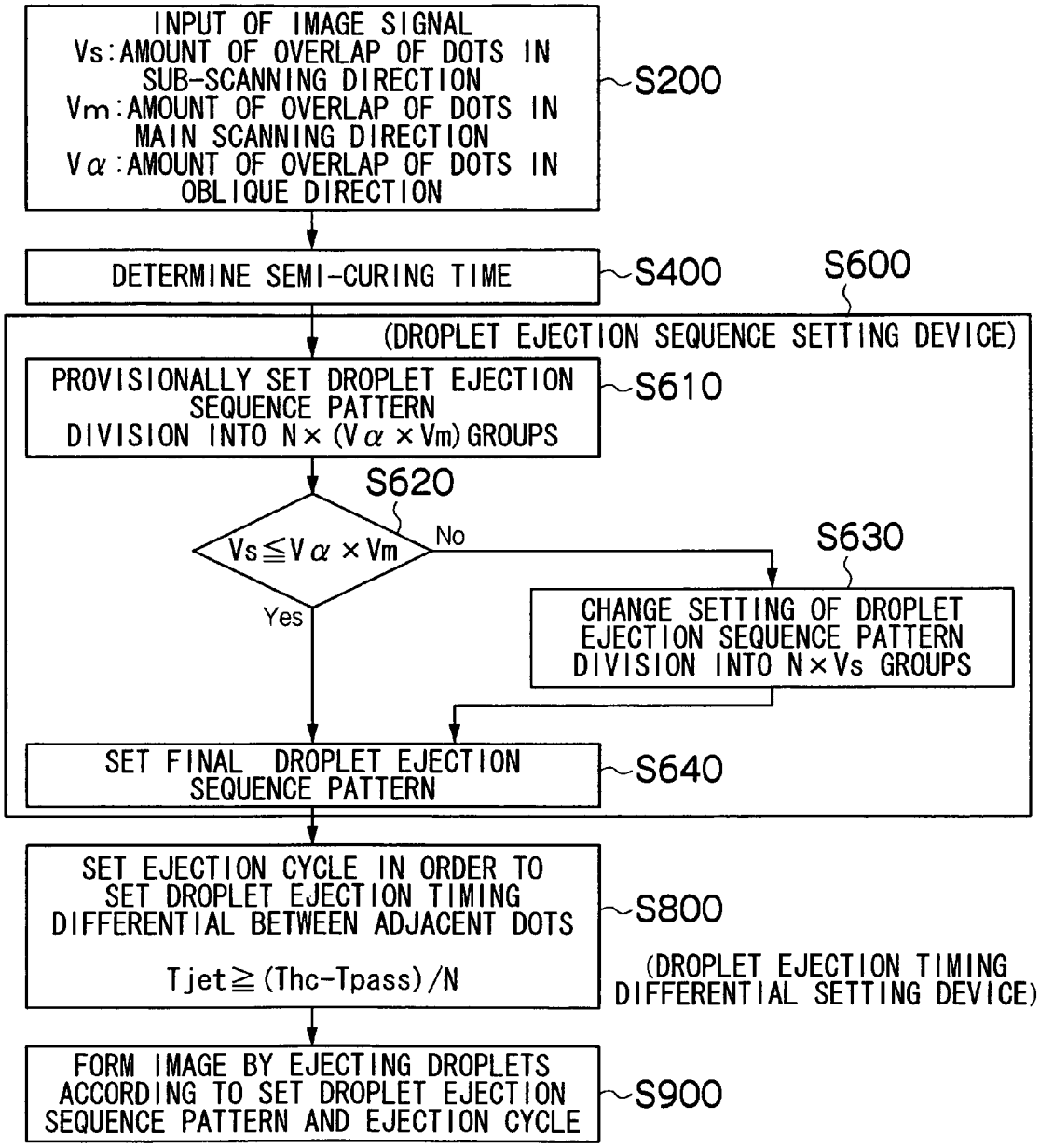
FIG. 15 is a flowchart showing a droplet ejection control method for preventing landing interference according to an embodiment.

Next, the droplet ejection control performed in order to prevent the occurrence of landing interference is described with reference to the flowchart in FIG. 15.

A case where droplets are ejected to form a solid image, which is the most demanding conditions in terms of landing interference, is described below. The solid image is one example used for the purpose of explanation, and needless to say, images other than a solid image can be formed by selectively omitting ejection from particular nozzles. Furthermore, this description relates to a case where the ink is monochrome, but even if inks of a plurality of colors are used, it is possible to perform similar droplet ejection control for each of the inks of the colors.

Firstly, an image signal is input from a host computer, or the like, to the image signal input device 284 (S200).

In general, the image signal includes data (image data) and the output resolution Rs which indicate the image to be formed on the intermediate transfer drum 232. There are also cases where the image processing device 285 determines the output resolution by compiling the image data.

The amount of overlap between dots in the sub-scanning direction is Vs, the amount of overlap between dots in the main scanning direction is Vm, and the amount of overlap between dots in the oblique direction is Vα.

Next, the (dot unit) semi-curing time Thc per dot is determined by the semi-curing time determination device 291.

More specifically, the dot semi-curing time Thc is identified on the basis of parameters relating to image formation, such as the ink type, the ultraviolet light irradiation conditions, and the dot diameter, by using the table information previously stored in the storage device 281 (S400).

Thereupon, grouping of the droplet ejection sequence of the dot pattern to be formed in the main scanning direction and the sub-scanning direction on the intermediate transfer drum 232 is performed by the droplet ejection sequence setting device 292 on the basis of the amount of overlap of the dots (S600).

Here, the grouping step (S600) is described in detail with respect to a mode in which the droplet ejection sequence is set on the basis of the amount of overlap of the dots in the oblique direction, Vα, at least.

Firstly, a droplet ejection sequence pattern indicating the droplet ejection sequence of the dots is set provisionally (S610).

More specifically, in terms of the sub-scanning direction, Vα×Vm is taken as the group base unit M, and groups each of which includes Vα×Vm dots arranged consecutively are formed on the basis of the amount of overlap of the dots in the oblique direction, Vα, and the amount of overlap of the dots in the main scanning direction, Vm, in such a manner that droplets are ejected at intervals of (Vα×Vm−1) dots apart. More specifically, the dots from the first dot to the (Vα×Vm) th dot are assigned to the first group, and thereafter, each of groups is formed by each string of (Vα×Vm) dots.

Furthermore, in terms of the main scanning direction, a phase difference equivalent to Vα dots is set between dots that are mutually adjacent in the main scanning direction, in such a manner that droplets are ejected at an interval of (Vm−1) dots apart, on the basis of the amount of overlap of dots in the main scanning direction, Vm.

By arranging the dots formed by droplets ejected in mutually adjacent and superimposed positions in the main scanning direction, it is possible to make the droplet ejection timing differential between the dots that are mutually adjacent in the main scanning direction and the oblique direction greater than the semi-curing time Thc of the dots, and hence it is possible to prevent landing interference.

The amount of overlap of the dots in the sub-scanning direction, Vs, is then compared with Vα×Vm (S620).

If "Vs>Vα×Vm" is satisfied, then the provisionally set droplet ejection sequence pattern is changed (S630). More specifically, in terms of the sub-scanning direction, the amount of overlap of the dots in the sub-scanning direction, Vs, is used as the group base unit M, and each group for Vs dots arranged consecutively is formed on the basis of the amount of overlap of the dots in the sub-scanning direction, Vs, in such a manner that droplets are ejected at intervals of (Vs−1) dots apart. More specifically, the dots from the first dot to the $Vs^{th}$ dot are assigned to the first group, and thereafter, each group is formed by each string of Vs dots. In respect of the main scanning direction, a phase difference is set between dots that are mutually adjacent in the main scanning direction.

After forming the groups in this way (S610, S620), the droplet ejection sequence pattern is finally established (S640). Here, a droplet ejection pattern is set for the droplet ejection timing differential setting device 293 and the droplet ejection control device 295.

Thereupon, in order to set the droplet ejection timing differential between adjacent dots, the nozzle ejection cycle Tjet is set in accordance with the droplet ejection sequence set by the droplet ejection sequence setting device 292 (S800).

More specifically, the nozzle ejection cycle Tjet is set in such a manner that "Tjet≧(Thc−Tpass)" is satisfied. Here, Thc represents the semi-curing time determined at step S400. Tpass represents the time period taken for the portion of the perimeter of the intermediate transfer drum 232 on which a transfer image is not formed to pass the print head 250. N represents the number of groups. By setting the nozzle ejection cycle Tjet in this fashion, the droplet ejection timing differentials between all of the mutually adjacent and mutually overlapping dots are set so as to become equal to or greater than the semi-curing time per dot.

By ejecting droplets from the nozzles onto the intermediate transfer drum 232 at the ejection cycle Tjet established in step S800, on the basis of the droplet ejection sequence set in step S600, a transfer image is formed on the intermediate transfer drum 232.

The steps of the image formation processing described above are in practice carried out by a microcomputer, in accordance with a program previously stored in the storage device 281.

Here, examples of grouping in various types of dot patterns having different dot overlap amounts (Vs, Vm, Vα) are described. All of the various examples described below satisfy the following prerequisites.

Prerequisites

Length in sub-scanning direction of recording medium (A4) onto which the image is eventually formed: Lp=300 mm Output resolution: Rs=2400 dpi (dot pitch Pt=10.6 μm)

Total number of dots on recording medium (A4) in sub-scanning direction: K=Lp/Pt=28301

Figure 16:
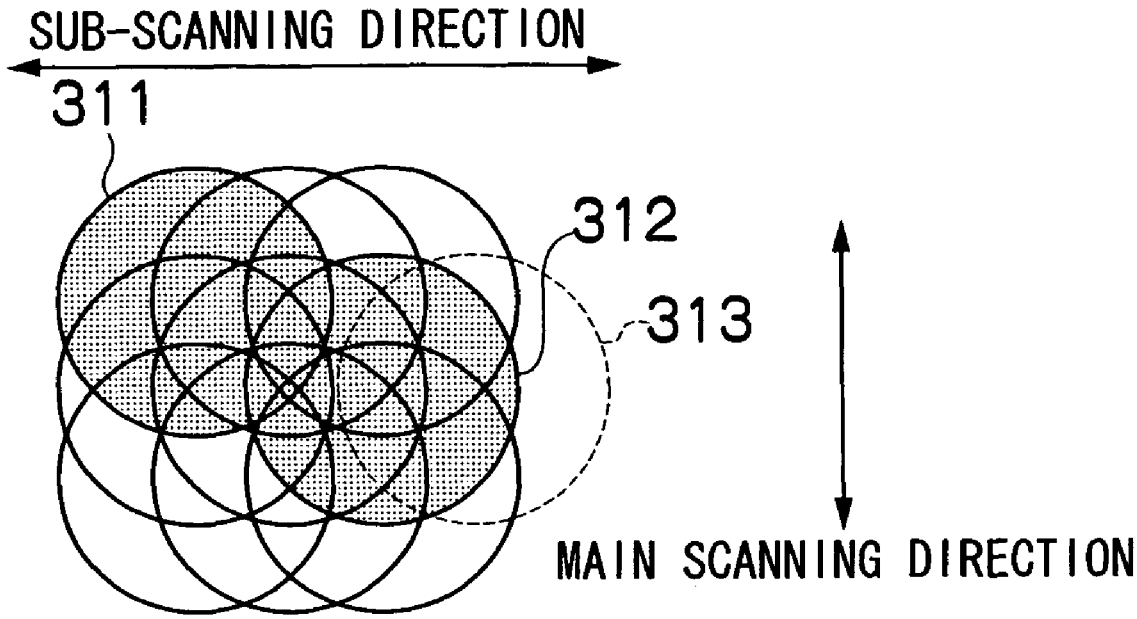
FIG. 16 is an illustrative diagram showing one example of a mode of dot overlap.

FIG. 16 shows one example of a state of dot overlap. In FIG. 16, the amount of overlap of the dots in the sub-scanning direction, Vs, is "3", and the amount of overlap of the dots in the main scanning direction, Vm, is "3".

If the position of the dot under consideration 311 is taken to be the first sub-scanning row and the first main scanning column, then it overlaps with the dot 312 situated in the third sub-scanning row, in the adjacent main scanning column (second main scanning column), but it does not overlap with the dot 313 situated in the fourth sub-scanning row, in that main scanning column (second main scanning column). In other words, the amount of overlap of the dot in the oblique direction, Vα, is "3". Here, the terms "row" and "column" are defined conveniently in order to describe the amount of overlap of the dots in the oblique direction, Vα, but apart from this description, a plurality of dots aligned in the sub-scanning direction is called a dot column.

Figure 17:
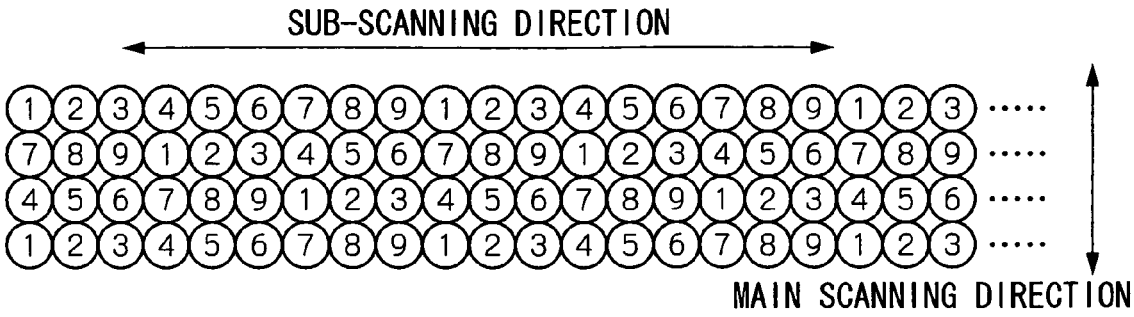
FIG. 17 is an illustrative diagram showing a droplet ejection sequence pattern in the overlap state in FIG. 16.

The base unit M for the grouping step satisfies "M=Vα×Vm=9". FIG. 17 shows a portion of the droplet ejection sequence pattern in a case where the groups are made by using the base unit M (M=9) such as this.

According to the prerequisites described above, since the total number of dots in the sub-scanning direction of the recording medium (A4), K, satisfies "K=Lp/Pt=28301", then the number of groups, N, satisfies "N=K/M=28301 dot/9=3145".

If the semi-curing time per dot Thc satisfies Thc=30 ms, and if the pass time Tpass which is the time period taken for the portion of the perimeter of the intermediate transfer drum 232 on which a transfer image is not formed to pass the print head 250 satisfies Tpass=0, then the nozzle ejection cycle Tjet satisfies "Tjet≧Thc=0.030/3415=8.7 μsec". However, in practice, it is difficult to make the nozzle ejection cycle Tjet smaller than the minimum ejection cycle of the nozzles, and therefore, if the minimum ejection cycle is 40 μsec, then the ejection cycle is set to this minimum ejection cycle of 40 μsec, rather than the nozzle ejection cycle Tjet. The rotational speed of the intermediate transfer drum 232 is 439 rpm (i.e., 1/(Tjet×N)×60=439 rpm.)

If the semi-curing time per dot Thc satisfies Thc=200 ms, and if the pass time Tpass which is the time period taken for the portion of the perimeter of the intermediate transfer drum 232 on which a transfer image is not formed to pass the print head 250 satisfies Tpass=0, then the nozzle ejection cycle Tjet satisfies "Tjet≧Thc/N=0.200/3415=58.5 μsec". The rotational speed of the intermediate transfer drum 232 is 300 rpm (i.e., 1/(Tjet×N)×60=300 rpm).

A general overview of the foregoing is given below. A case is considered in which the amount of overlap in the sub-scanning direction is Vs, the amount of overlap in the main scanning direction is Vm, and a dot in row i (sub-scanning row) and column j (main scanning column) overlaps with dots up to row (i+1) and column (j+α). In this case, a group division pattern is determined so that dots are separated into N groups which each include the (α×Vm) dots arranged consecutively in the sub-scanning direction. In other words, the total number of dots is N×(α×Vm). If "α×Vm<Vs" is satisfied, then the total number of dots is set to be N×Vs.

The groups are made by dividing the dots in the groups into sets, namely, a first set to a (α×Vm)th set, on the basis of the α×Vm dots used as a base group. Thereupon, droplets are ejected sequentially to forms dots of the first set only, in the first group to the Nth group. In this step, droplets are ejected to form dots situated at intervals of (α×Vm−1) dots apart.

Thereupon, droplets are ejected consecutively to forms dots of the second set only, in the first group to the Nth group. Similarly, droplets are ejected consecutively to forms dots of the Mth set only, in the first group to the Nth group.

By setting the droplet ejection sequence as described above, it is possible to prevent landing interference and to obtain images of high quality at high speed.

An image forming apparatus and an image forming method according to the present invention are described in detail above, but the present invention is not limited to such examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a plurality of ejection heads which eject liquid containing, a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, an ultraviolet-polymerizable compound, and a coloring material, onto a medium;

a semi-curing device which radiates, at least once, ultraviolet light having at least a wavelength which is in the first wavelength range and which is on a longer wavelength side from the second wavelength range, onto dots formed by the liquid ejected from the ejection heads onto the medium;

an intermediate processing device which performs intermediate processing of an image formed on the medium by the dots; and a main curing device which radiates ultraviolet light having at least a wavelength in the second wavelength range, onto the image which has undergone intermediate processing by the intermediate processing device.

2. The image forming apparatus as defined in claim 1, wherein a combination ratio of the first ultraviolet curing initiator, the second ultraviolet curing initiator and the ultraviolet polymerizable compound contained in the liquid containing the coloring material corresponding to one color is a combination ratio whereby the liquid is in a semi-cured state even when the liquid is irradiated with the ultraviolet light a plurality of times by the semi-curing device, and the liquid achieves a fully cured state if the liquid is irradiated with the ultraviolet light by the main curing device.

3. The image forming apparatus as defined in claim 1, wherein the intermediate processing device is a smoothing device which smoothes the liquid on the medium.

4. The image forming apparatus as defined in claim 3, wherein the smoothing device includes a pressurizing device which applies pressure to the coloring material on the medium.

5. The image forming apparatus as defined in claim 3, wherein the smoothing device includes a heating device which heats the coloring material on the medium.

6. The image forming apparatus as defined in claim 3, further comprising a control device which controls at least one of a smoothing condition of the smoothing device and energy radiated by the semi-curing device, according to at least one of the a type of the medium, a type of the liquid and an amount of the liquid deposited onto the medium.

7. The image forming apparatus as defined in claim 1, wherein, the medium is an intermediate transfer rotating medium;

the intermediate processing device is a transfer device which transfers the image formed on the intermediate transfer rotating medium onto a recording medium; and the main curing device radiates the ultraviolet light onto the recording medium.

8. The image forming apparatus as defined in claim 7, further comprising:

a semi-curing time determination device which determines a semi-curing time of the dots formed on the intermediate transfer rotating medium;

a droplet ejection sequence setting device which sets droplet ejection sequence of the dots in a sub-scanning direction corresponding to a direction of rotation of the intermediate transfer rotating medium and a main scanning direction being perpendicular to the sub-scanning direction, according to at least a degree of overlap between the dots in an oblique direction which is inclined with respect to the sub-scanning direction; and a droplet ejection timing differential setting device which sets a droplet ejection timing differential between the dots which are adjacent to and overlap with each other in such a manner that the droplet ejection timing differential between the dots which are adjacent to each other is not less than the semi-curing time of the dots.

9. An image forming method, comprising the steps of:

ejecting a liquid containing a first ultraviolet curing initiator having spectral absorption characteristics at least in a first wavelength range, a second ultraviolet curing initiator which has spectral absorption characteristics at least in a second wavelength range being on a shorter wavelength side from the first wavelength range and has no spectral absorption characteristics in the first wavelength range, an ultraviolet-polymerizable compound and a coloring material, onto a medium from a plurality of ejection heads;

radiating, at least once, ultraviolet light having at least a wavelength which is in the first wavelength range and which is on a longer wavelength side from the second wavelength range, onto dots formed by the liquid ejected onto the medium in such a manner that semi-curing is performed;

applying intermediate processing to an image formed by the dots which are semi-cured on the medium; and radiating ultraviolet light having at least a wavelength in the second wavelength range, onto the image which has undergone the intermediate processing in such a manner that main curing is performed.

* * * * *